US011197514B2

(12) United States Patent
Kohatsu et al.

(10) Patent No.: US 11,197,514 B2
(45) Date of Patent: Dec. 14, 2021

(54) LAYERED SOLE STRUCTURE FOR AN ARTICLE OF FOOTWEAR

(71) Applicant: NIKE, Inc., Beaverton, OR (US)

(72) Inventors: Shane S. Kohatsu, Portland, OR (US); Christopher S. Cook, Portland, OR (US); Matthew R. Pauk, Portland, OR (US); Oliver McLachlan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 547 days.

(21) Appl. No.: 15/056,153

(22) Filed: Feb. 29, 2016

(65) Prior Publication Data

US 2017/0245590 A1 Aug. 31, 2017

(51) Int. Cl.

| | |
|---|---|
| ***A43B 13/18*** | (2006.01) |
| ***A43B 13/12*** | (2006.01) |
| ***A43B 13/02*** | (2006.01) |
| ***A43B 13/04*** | (2006.01) |
| ***A43B 13/14*** | (2006.01) |
| ***A43B 13/22*** | (2006.01) |
| ***A43B 13/16*** | (2006.01) |
| ***A43B 3/00*** | (2006.01) |

(52) U.S. Cl.

CPC ..... *A43B 13/186* (2013.01); *A43B 3/0042* (2013.01); *A43B 13/026* (2013.01); *A43B 13/04* (2013.01); *A43B 13/12* (2013.01); *A43B 13/127* (2013.01); *A43B 13/141* (2013.01); *A43B 13/16* (2013.01); *A43B 13/181* (2013.01); *A43B 13/183* (2013.01); *A43B 13/188* (2013.01); *A43B 13/223* (2013.01)

(58) Field of Classification Search

CPC .... A43B 13/186; A43B 3/0042; A43B 13/026
USPC ..... 36/28, 25
See application file for complete search history.

(56) References Cited

U.S. PATENT DOCUMENTS

| | | | | |
|---|---|---|---|---|
| 1,701,611 | A | 2/1929 | Glidden et al. | |
| 5,185,943 | A * | 2/1993 | Tong | A43B 5/00 36/27 |
| 5,720,118 | A | 2/1998 | Mayer et al. | |
| 6,216,365 | B1 * | 4/2001 | Cohen | A43B 7/144 36/102 |
| 7,421,805 | B2 * | 9/2008 | Geer | A43B 3/0036 36/102 |
| 8,615,835 | B2 | 12/2013 | Hoffer et al. | |

(Continued)

FOREIGN PATENT DOCUMENTS

| | | | |
|---|---|---|---|
| CN | 104159465 | A | 11/2014 |
| DE | 202012010878 | U1 | 11/2012 |

OTHER PUBLICATIONS

Jun. 7, 2017—(WO) International Search Report and Written Opinion—App PCT/US2017/019681.
Sep. 17, 2020—(EP) Office Action—App. No. 17710453.6.

*Primary Examiner* — Alissa J Tompkins
*Assistant Examiner* — Catherine M Ferreira
(74) *Attorney, Agent, or Firm* — Banner & Witcoff, Ltd.

(57) ABSTRACT

A sole structure can include provisions for improving the cushioning characteristics and stability of an article of footwear. The sole structure may include multiple layers with specialized structural properties designed to integrate regions of stiffness with cushioning layers. In some cases, the sole structure can include at least two independent stability layers that differ in stiffness.

22 Claims, 13 Drawing Sheets

(56) References Cited

U.S. PATENT DOCUMENTS

| | | | | |
|---|---|---|---|---|
| 2001/0001907 | A1 | 5/2001 | Luthi et al. | |
| 2001/0007177 | A1 | 7/2001 | Brown et al. | |
| 2004/0111920 | A1* | 6/2004 | Cretinon | A43B 13/12 36/30 R |
| 2012/0210606 | A1* | 8/2012 | Gheorghian | A43B 5/06 36/103 |
| 2014/0026443 | A1 | 1/2014 | Derrier | |
| 2014/0202031 | A1 | 7/2014 | Seo | |
| 2016/0029741 | A1 | 2/2016 | Foxen | |

* cited by examiner

LAYERED SOLE STRUCTURE FOR AN ARTICLE OF FOOTWEAR

BACKGROUND

The present embodiments relate generally to articles of footwear and articles of footwear for use during running or other athletic activities.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

SUMMARY

In one aspect, the present disclosure is directed to a sole structure for an article of footwear, comprising a forefoot portion, a midfoot portion, and heel portion, and a first stability layer, a second stability layer, and a cushioning layer. The cushioning layer is disposed between the first stability layer and the second stability layer, and the cushioning layer extends continuously through the forefoot portion, midfoot portion, and heel portion. Furthermore, the first stability layer has a first stiffness, the second stability layer has a second stiffness, and the first stiffness is greater than the second stiffness.

In another aspect, the present disclosure is directed to a sole system for an article of footwear, the sole system comprising a forefoot portion, a midfoot portion, and heel portion, and a sole structure with at least three layers, including a first layer, a second layer, and a third layer. The sole structure is disposed between an upper and a ground-contacting outsole of the article of footwear. The second layer is disposed between the first layer and the third layer, where the first layer has a first stiffness; the second layer has a second stiffness; and the third layer has a third stiffness. Furthermore, the first stiffness is greater than the second stiffness; the third stiffness is greater than the second stiffness; the first stiffness is greater than the third stiffness; and the sole structure is configured to disperse pressure throughout the sole structure.

In another aspect, the present disclosure is directed to an article of footwear, comprising a forefoot portion, a midfoot portion, and heel portion, a first stability layer, a second stability layer, and a cushioning layer. The cushioning layer is disposed between the first stability layer and the second stability layer, and the first stability layer being associated with a first stiffness, while the second stability layer is associated with a second stiffness. In addition, the first stiffness is greater than the second stiffness. Furthermore, the cushioning layer has a proximal side and a distal side, the proximal side and the distal side corresponding to opposing sides of the cushioning layer. The proximal side is disposed adjacent to the first stability layer, and the distal side is disposed adjacent to the second stability layer, where the proximal side of the cushioning layer includes at least one exposed region, and the distal side of the cushioning layer includes at least one exposed region.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
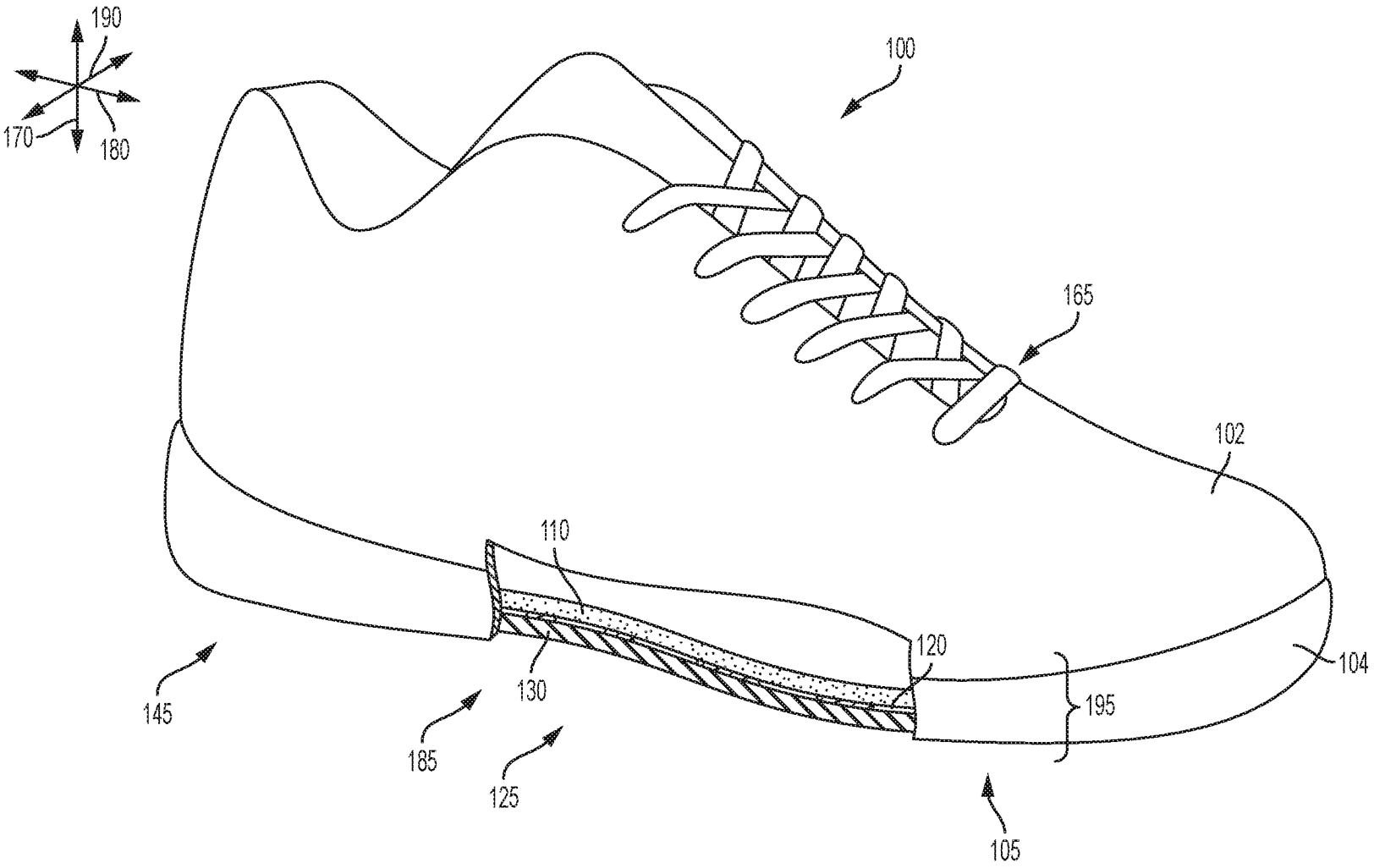
FIG. 1 is an isometric view of an embodiment of an article of footwear.

The following discussion and accompanying figures disclose embodiments of a sole structure 104 for an article of footwear 100, as shown in FIG. 1. The provisions discussed herein for the article of footwear and sole structure could be incorporated into various other kinds of footwear including, but not limited to, basketball shoes, hiking boots, soccer shoes, football shoes, sneakers, running shoes, cross-training shoes, rugby shoes, rowing shoes, baseball shoes as well as other kinds of shoes. Moreover, in some embodiments, the provisions discussed herein for article of footwear 100 could be incorporated into various other kinds of non-sports-related footwear, including, but not limited to, slippers, sandals, high-heeled footwear, and loafers. Accordingly, the concepts disclosed herein apply to a wide variety of footwear types.

For purposes of clarity, the following detailed description discusses the features of article of footwear 100, also referred to simply as article 100. However, it will be understood that other embodiments may incorporate a corresponding article of footwear (e.g., a left article of footwear when article 100 is a right article of footwear) that may share some, and possibly all, of the features of article 100 described herein and shown in the figures.

To assist and clarify the subsequent description of various embodiments, various terms are defined herein. Unless otherwise indicated, the following definitions apply throughout this specification (including the claims).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). A longitudinal direction may extend along a longitudinal axis, which itself extends between a forefoot portion and a heel portion of the component. The term "forward" is used to refer to the general direction in which the toes of a foot point, and the term "rearward" is used to refer to the opposite direction, i.e., the direction in which the heel of the foot is facing. The terms forward and rearward may be used to describe the location of elements relative to one another along the sole structure.

In addition, the term "lateral" as used throughout this detailed description and in the claims refers to a direction extending along a width of a component. A lateral direction may extend along a lateral axis, which itself extends between a medial side and a lateral side of a component. In other words, the lateral direction may extend between a medial side and a lateral side of an article of footwear, with the lateral side of the article of footwear being the surface that faces away from the other foot, and the medial side being the surface that faces toward the other foot.

Furthermore, the term "vertical" as used throughout this detailed description and in the claims refers to a direction extending along a vertical axis, which itself is generally perpendicular to a lateral axis and a longitudinal axis. For example, in cases where an article is planted flat on a ground surface, a vertical direction may extend from the ground surface upward. This detailed description makes use of these directional adjectives in describing an article and various components of the article, including an upper, a midsole structure, and/or an outer sole structure.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading toward the ground surface. Similarly, the terms "top," "upper" (when not used in context of the upper component in an article of footwear), and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe interior in the completed shoe. In some cases, the inner side of an element may have other elements between that inner side and the interior in the completed shoe. Similarly, an outer side of an element may have other elements between that outer side and the space external to the completed shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or upper. Thus, the terms proximal and distal may be understood to provide generally opposing terms to describe the relative spatial position of a footwear layer.

Furthermore, throughout the following description, the various layers or components of sole structure 104 may be described with reference to a proximal side and a distal side. In embodiments in which sole structure 104 comprises multiple layers (as will be discussed further below), the proximal side will refer to the surface or side of the specified layer that faces the upper and/or faces toward the foot-receiving interior cavity formed in the article. In addition, the distal side will refer to a side of the layer that is opposite to the proximal side of the layer. In some cases, the distal side of a layer is associated with the outermost surface or side. Thus, a proximal side may be a side of a layer of sole structure 104 that is configured to face upward, toward a foot or a portion of an upper. A distal side may be a surface side of a layer of sole structure 104 that is configured to face toward a ground surface during use of the article.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

FIG. 1 illustrates a schematic isometric view of an embodiment of article 100 with sole structure 104. As noted above, for consistency and convenience, directional adjectives are employed throughout this detailed description. Article 100 may be divided into three general regions along a longitudinal axis 180: a forefoot portion 105, a midfoot portion 125, and a heel portion 145. Forefoot portion 105 generally includes portions of article 100 corresponding with the toes and the joints connecting the metatarsals with the phalanges. Midfoot portion 125 generally includes portions of article 100 corresponding with an arch area of the foot. Heel portion 145 generally corresponds with rear portions of the foot, including the calcaneus bone. Forefoot portion 105, midfoot portion 125, and heel portion 145 are not intended to demarcate precise areas of article 100. Rather, forefoot portion 105, midfoot portion 125, and heel portion 145 are intended to represent general relative areas of article 100 to aid in the following discussion. Since various features of article 100 extend beyond one region of article 100, the terms forefoot portion 105, midfoot portion 125, and heel portion 145 apply not only to article 100 but also to the various features of article 100.

Referring to FIG. 1, for reference purposes, a lateral axis 190 of article 100, and any components related to article 100, may extend between a medial side 165 and a lateral side 185 of the foot. Additionally, in some embodiments, longitudinal axis 180 may extend from forefoot portion 105 to heel portion 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

Article 100 may include an upper 102 and sole structure 104. Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

As shown in FIG. 1, upper 102 may include one or more material elements (for example, meshes, textiles, knit, braid, foam, leather, and synthetic leather), which may be joined to define an interior void configured to receive a foot of a wearer. The material elements may be selected and arranged to impart properties such as light weight, durability, air permeability, wear resistance, flexibility, and comfort. Upper 102 may include an opening through which a foot of a wearer may be received into the interior void.

At least a portion of sole structure 104 may be fixedly attached to upper 102 (for example, with adhesive, stitching, welding, or other suitable techniques) and may have a configuration that extends between upper 102 and the ground. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

In some embodiments, sole structure 104 may be configured to provide traction for article 100. In addition to providing traction, sole structure 104 may attenuate ground reaction forces when compressed between the foot and the ground during walking, running, or other ambulatory activities. The configuration of sole structure 104 may vary significantly in different embodiments to include a variety of conventional or non-conventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is hard or soft. In addition, sole structure 104 may be tailored for use in wet or dry conditions. Furthermore, sole structure 104 may be configured differently for use on different surfaces for different event types, such as for hard indoor surfaces (such as hardwood), soft, natural turf surfaces, or on hard, artificial turf surfaces. In some embodiments, sole structure 104 may be configured for use on multiple different surfaces.

In some embodiments, sole structure 104 may be configured for a particularly specialized athletic activity or event. Accordingly, in some embodiments, sole structure 104 may be configured to provide support, cushioning, rigidity, stability, and/or traction for a specific plantar pressure or usage type. Furthermore, a sole structure can include provisions for distributing forces throughout different portions of the sole structure. In some embodiments, a sole structure may include provisions for forming a sole system with multiple layers that can be customized, tailored, or otherwise configured to provide particular cushioning effects and responses while maintaining a high degree of stability.

In different embodiments, sole structure 104 may include multiple layers, which may individually or collectively provide article 100 with a number of attributes, such as support, rigidity, flexibility, stability, cushioning, comfort, reduced weight, or other attributes. In some embodiments, a sole system of sole structure 104 may be a layered structure. For purposes of this disclosure, a layer refers to a segment or portion of the sole structure that extends along a horizontal direction or is disposed within a substantially similar level of the sole structure. In one embodiment, the layer can be likened to a stratum in the earth, for example. In other words, a layer can be a horizontally arranged section of the sole structure that can be disposed above, between, or below other adjacent layers of materials. Each layer can incorporate one or more portions of increased or decreased stiffness or rigidity relative to other layers in sole structure 104. In some embodiments, a layer may comprise various composite materials that enhance structural support. In other embodiments, a layer may comprise materials configured to distribute forces applied along the sole structure.

Generally, sole structure 104 may comprise any number of layers. In some cases, sole structure 104 can comprise two or more layers. In other cases, sole structure 104 can comprise three layers. In still other embodiments, however, sole structure 104 may include four, five, or six layers. In one embodiment, as shown in the cutaway view of FIG. 1, sole structure 104 includes a first layer 110, a second layer 120, and a third layer 130. In other embodiments, the sole structure of an article of footwear may further (or alternatively) include a midsole, an insole, a ground-contacting outsole, or other sole components or layers. In some cases, however, one or more of these components or layers may be omitted. Thus, it should be understood that the layers described herein (including the various cushioning layers and stability layers, as will be discussed below) refer to layers that may contact or be disposed adjacent to a midsole, an insole, a sockliner, a ground-contacting outsole, or other sole members and components in different embodiments. In some embodiments, the sole structure embodiments disclosed herein may be understood to be disposed between an upper and a ground-contacting outsole in an assembled article of footwear.

In FIG. 1, first layer 110 is disposed nearest, or most proximal, to upper 102. Second layer 120 is disposed adjacent to the lower surface or distal surface of first layer 110. Furthermore, second layer 120 is disposed between first layer 110 and third layer 130. Furthermore, in this embodiment, third layer 130 corresponds to the bottom-most layer, or the layer nearest to the ground. In other words, relative to vertical axis 170, first layer 110 is disposed above second layer 120, and second layer 120 is disposed above third layer 130. Thus, third layer 130 may include a ground-contacting surface of sole structure 104.

In different embodiments, each layer may provide different features, properties, responses, and/or characteristics to sole structure 104. In some embodiments, each layer may contribute to a sole system 195 that can provide various cushioning and stability responses to article 100. In different embodiments, the layers may be modified or configured to provide specific properties. The following figures represent several possible embodiments of the disclosure for purposes of illustration. However, it should be understood that other embodiments may include variations to one or more layers that differ from those illustrated with reference to FIGS. 1-13. Thus, other embodiments can include different types of sole systems with properties resulting from the combination of a variety of different types of layers.

Figure 2:
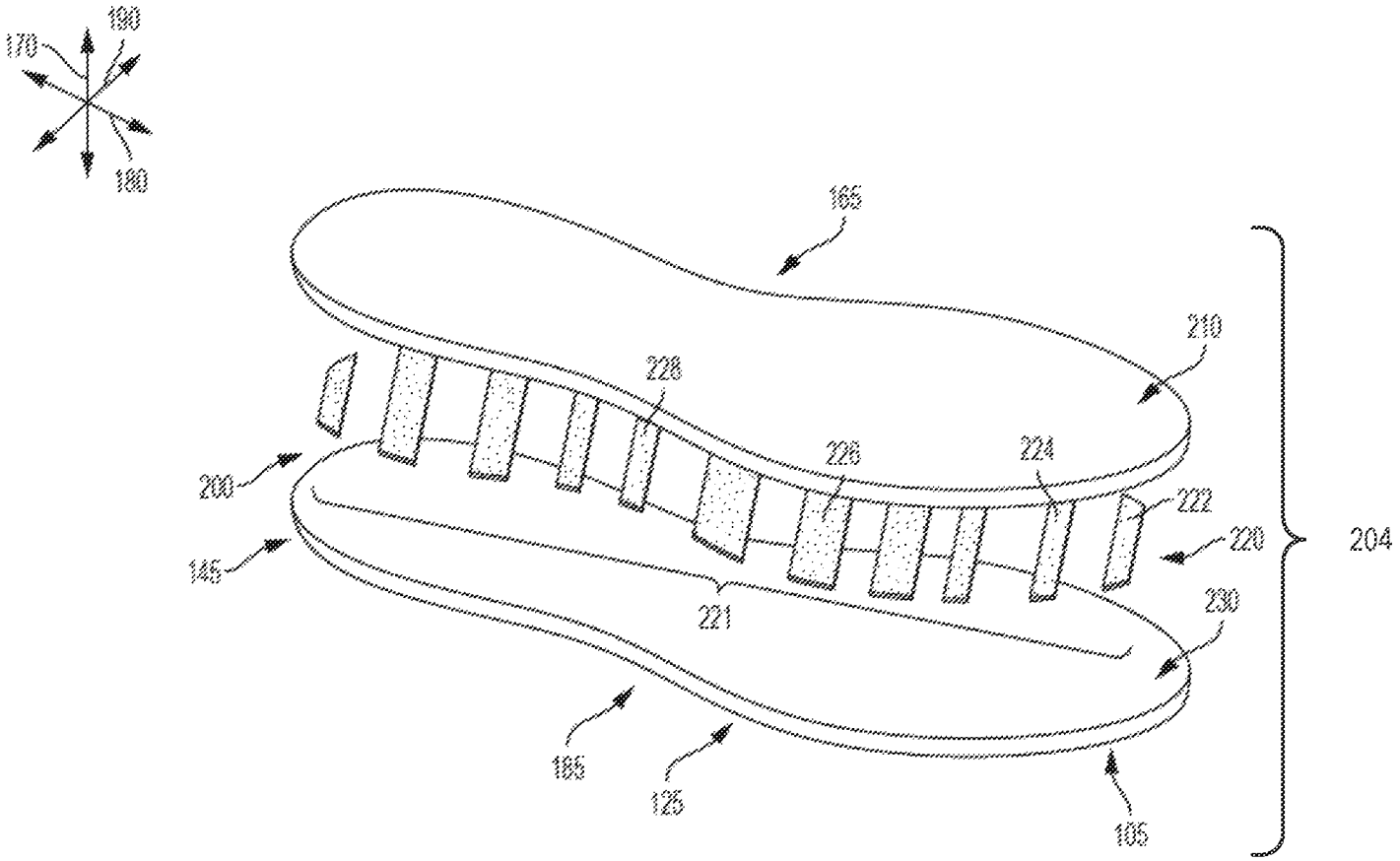
FIG. 2 is an isometric exploded view of an embodiment of a sole structure.
Figure 3:
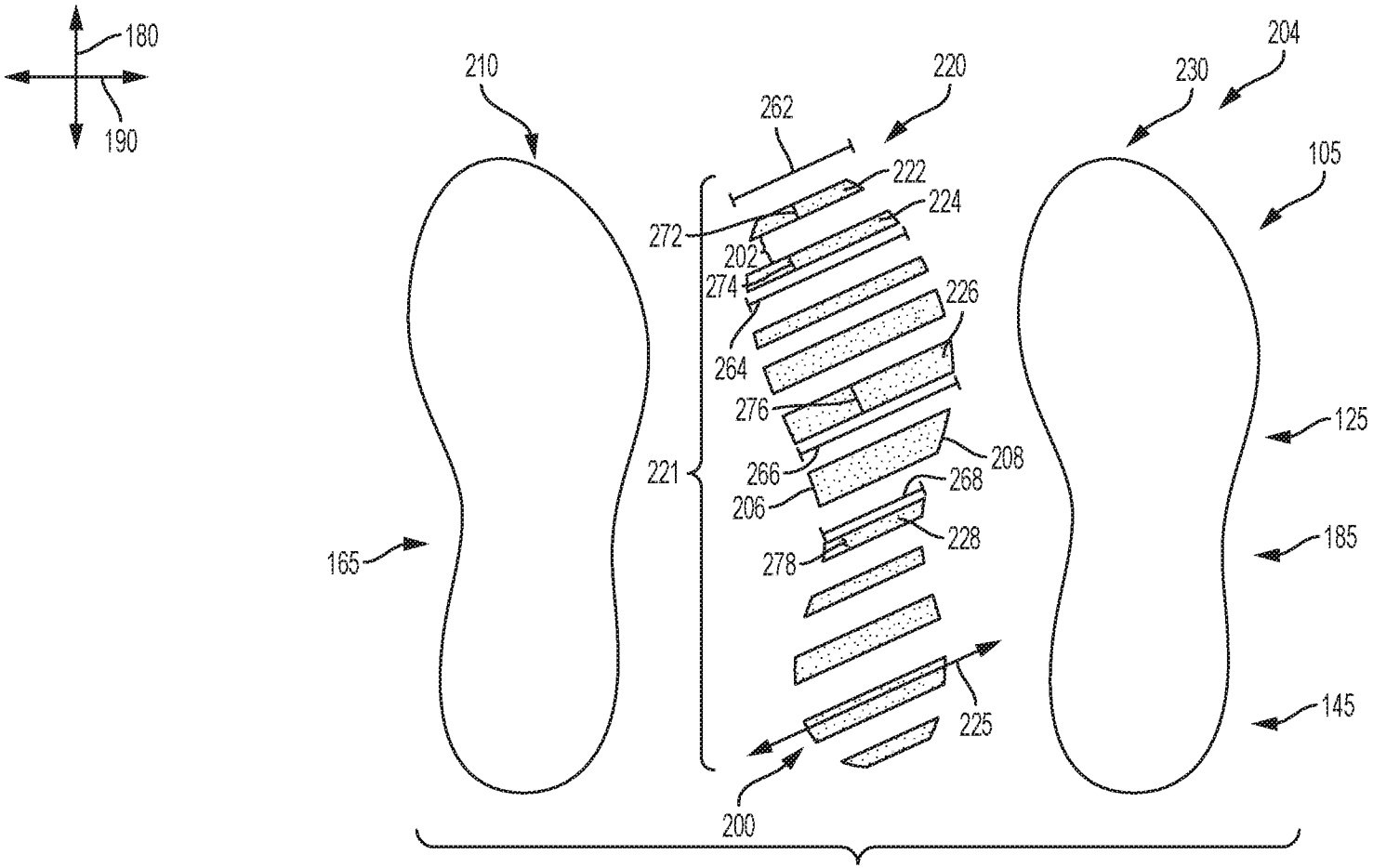
FIG. 3 is a schematic top-down view of an embodiment of some layers of the sole structure of FIG. 2.

One embodiment of a first sole structure ("first sole") 204 is depicted in FIGS. 2 and 3, including a first layer 210, a second layer 220, and a third layer 230. In order to provide the reader with a greater understanding of the proposed embodiments, two views are depicted of the layers of first sole 204 in FIGS. 2 and 3. In FIG. 2, an isometric exploded view of an embodiment of first sole 204 is illustrated, and in FIG. 3, a top-down exploded view of an embodiment of the layers of first sole 204 is illustrated.

In some cases, there may be one or more layers that are configured to provide cushioning characteristics to a sole. These layers will be referred to collectively herein as "cushioning layer(s)." For example, in some embodiments, first layer 210 and third layer 230 may be formed of a deformable (e.g., compressible) material. Accordingly, in one embodiment, first layer 210, and/or third layer 230 may comprise cushioning layers, by virtue of their compressibility, and provide cushioning to and/or conform to a foot in order to enhance comfort, support, and stability.

First layer 210 and/or third layer 230 may be fixedly attached to a lower area of upper 102 of FIG. 1, for example, through stitching, adhesive bonding, thermal bonding (such as welding), or other techniques, or may be integral with upper 102. First layer 210 and/or third layer 230 may be formed from any suitable material having the properties described above, according to the activity for which article 100 is intended. In some embodiments, first layer 210 and/or third layer 230 may include a foamed polymer material, such as polyurethane (PU), ethyl vinyl acetate (EVA), other polymer foam materials, or any other suitable material that operates to attenuate ground reaction forces as first sole 204 contacts the ground during walking, running, or other ambulatory activities. In some cases, first layer 210 and/or third layer 230 may include plastics, thermoplastics, foams, rubbers, composite materials, elastomeric materials, as well as any other kinds of materials. In one embodiment, first layer 210 and/or third layer 230 may comprise a rubber or a rubber-coated material with a high level of grip. It will also be understood that in other embodiments, first layer 210 and/or third layer 230 could be made of substantially different materials.

As shown in FIGS. 2 and 3, first layer 210 and/or third layer 230 may extend continuously (e.g., without breaks or gaps) through each of forefoot portion 105, midfoot portion 125, and heel portion 145. Furthermore, in one embodiment, first layer 210 and/or third layer 230 may extend in a substantially continuous manner between lateral side 185 and medial side 165 of article 100. In other words, in some embodiments, cushioning layers can extend in a continuous manner throughout a horizontal plane of first sole 204.

In some embodiments, first sole 204 can include additional layers that can provide strength and support for first sole 204. For purposes of reference, such layers will be referred to as "stability layer(s)" throughout this disclosure. In some embodiments, second layer 220 may comprise a stability layer. In one embodiment, second layer 220 may comprise a structure that increases the stiffness or support properties of the sole.

In different embodiments, second layer 220 can include a first set 221 of substantially rigid elements 200, or simply elements 200, that are configured to increase stability for first sole 204 in one embodiment. For purposes of reference, an element in this disclosure can refer to a portion of a layer that is spaced apart from other portions of the same layer. The sizes and shapes of elements 200 of first set 221 comprising second layer 220 may be varied in different embodiments to achieve a desired degree of support for first sole 204, as will be discussed further below. Therefore, in some embodiments, second layer 220 comprises a substantially asymmetrical structure comprising of multiple spaced-apart elements.

Furthermore, the materials comprising second layer 220 could vary in different embodiments. Generally, materials for each element or stability layer may be selected to achieve desired material properties including, but not limited to, strength, durability, flexibility, rigidity, weight as well as other material properties. As one example, materials for second layer 220 could be selected to achieve a substantially rigid component that is lightweight and durable. In some embodiments, portions of or all of second layer 220 may comprise one or more composite materials. Examples of composite materials include, but are not limited to, plastic fiber-reinforced composite materials (including short fiber-reinforced materials and continuous fiber-reinforced materials), fiber-reinforced polymers (including carbon fiber, carbon-fiber-reinforced plastic and glass-reinforced plastic), carbon nanotube reinforced polymers, as well as any other kind of composite materials or other plastics known in the art. In one embodiment, second layer 220 may be made of carbon fiber or carbon-fiber-reinforced plastic. Examples of other kinds of materials that may be used include, but are not limited to, metals, polymers, plastics, thermoplastics, foams, rubbers, composite materials, as well as any other kinds of materials. In one embodiment, second layer 220 may comprise a substantially rigid plastic. It will also be understood that in other embodiments, second layer 220 could be made of substantially different materials.

In some embodiments, portions of second layer 220 may comprise a substantially flat or two-dimensional material or structure. The term "two-dimensional" as used throughout this detailed description and in the claims refers to any generally flat material exhibiting a length and width that are substantially greater than a thickness of the material. Although two-dimensional materials may have smooth or generally untextured surfaces, some two-dimensional materials will exhibit textures or other surface characteristics, such as dimpling, protrusions, ribs, or various patterns, for example.

Generally, the material properties of second layer 220 may vary in different embodiments. In some embodiments, the relative rigidity associated with each element may be configured to modify, tune, or otherwise adjust the overall stability, flexibility, and structural support through first sole 204. For example, in some cases, second layer 220 may be less rigid than first layer 210, and/or third layer 230. In other embodiments, second layer 220 may have a rigidity that is substantially similar to the rigidity of first layer 210 and/or third layer 230. In still other embodiments, as in FIGS. 2 and 3, elements 200 comprising second layer 220 are substantially more rigid than the material of first layer 210 and/or third layer 230. Moreover, in some cases, the rigidity of second layer 220 may vary according to the materials used.

Thus, in different embodiments, second layer 120 can include a plurality of elements 200. In some embodiments, first set 221 may include at least two elements or portions of second layer 120 that are spaced apart from one another. In other embodiments, first set 221 may include between three and 15 elements. In the embodiment of FIGS. 2 and 3, first set 221 comprises 11 elements. For purposes of reference, a first element 222, a second element 224, a third element 226, and a fourth element 228 are identified.

In different embodiments, the geometry of each element may be configured to provide specialized support properties to second layer 120. In some embodiments, one or more elements may have a rectangular, parallelogram-like, trapezoid-like, strip-like shape, or an otherwise oblong shape. For example, in FIG. 3, elements 200 of second layer 220 comprise a generally elongated shape with four linear sides or edges. For purposes of this disclosure, an elongated shape is associated with a shape that includes a substantially larger length than width. However, in other embodiments, elements 200 may include any regular or irregular shape. Furthermore, the perimeter of an element may include linear sides, curved sides, or undulating sides, for example.

In some cases, elements 200 of second layer 220 may extend the full length and/or width of first sole 204. In other cases, however, second layer 220 could extend through specific portions of first sole 204. As shown in FIGS. 2 and 3, the elements of first set 221 of second layer 220 are arranged in a staggered manner through forefoot portion 105, midfoot portion 125, and heel portion 145. In some embodiments, elements 200 of second layer 220 can extend in a continuous manner between lateral side 185 and medial side 165 over at least some portions of first sole 204.

The arrangement of elements 200 may differ in different embodiments. In FIGS. 2 and 3, elements 200 are disposed in a substantially parallel arrangement with respect to one another. Furthermore, as shown in FIG. 3, each element extends from a first end 206 on medial side 165 to a second end 208 on lateral side 185. Thus, in some embodiments, elements 200 can be arranged along a direction substantially aligned with lateral axis 190. However, it should be understood that in other embodiments, elements 200 may extend in a direction aligned more with longitudinal axis 180, where first end 206 of an element is associated with forefoot portion 105 and second end 208 is associated with heel portion 145, for example.

In some embodiments, an area (size) of one element may be substantially similar to that of another element, or an element may have a different area (size). Similarly, the dimensions of one element may be similar to the dimensions of another element, or may be substantially similar to the dimensions of another element. In FIG. 3, first element 222 has a first length 262 and a first width 272, second element 224 has a second length 264 and a second width 274, third element 226 has a third length 266 and a third width 276, and fourth element 228 has a fourth length 268 and a fourth width 278. It can be seen that fourth length 268 is less than first length 262; first length 262 is less than second length 264; and second length 264 is less than third length 266. In addition, third width 276 is greater than first width 272, and first width 272 is greater than second width 274. Furthermore, first width 272 is substantially similar to fourth width 278. Furthermore, the thickness associated with an element can be varied in order to adjust the stiffness or flexibility of the element, for example.

Thus, each element can differ in size from other elements in first set 221. In different embodiments, the dimensions (including length, width, area, and/or thickness) of each element may be configured to provide specific support responses to first sole 204. In some embodiments, an element may be wider in one region of second layer 120 to provide a wearer with greater stability. For example, an element may be wider in midfoot portion 125 relative to other portions in order to provide increased support in the arch.

Furthermore, the varying size of the gaps or spaces between one element and an adjacent element can provide first sole 204 with increased flexibility in second layer 220. In some embodiments, each gap may be understood to form an exposed region along one side of the adjacent cushioning layer. In one embodiment, a gap can reduce the cross-sectional profile of the layer at particular regions and/or to facilitate increased flexibility between various portions of the layer. In another embodiment, the gaps or spaces between portions of the layer can produce regions between adjacent portions that permit articulation or bending with respect to one another.

As shown in FIG. 3, first element 222 and second element 224 are spaced apart by a first gap 202. First gap 202 can have a width and a length substantially similar to that of first element 222 in some embodiments. In other embodiments, first gap 202 can have a width and a length substantially similar to that of second element 224. However, in other cases, first gap 202 can comprise any area, such that the gap is substantially wider than any of elements 200. First gap 202 may allow a hinge portion or region of bending to exist between first element 222 and second element 224 in some embodiments. In other words, in some embodiments, different areas of first sole 204 may function as a hinge, permitting the turning, bending, flexing, or movement of various layers. In particular, in some embodiments, edges or areas connecting adjacent portions or elements of a sole layer may flex about the gaps between neighboring elements. In one embodiment, first gap 202 may be comprised of the space extending between first element 222 and second element 224. It should be understood that the gaps formed between other adjacent elements may differ in size relative to first gap 202.

Thus, in some embodiments, the proximal surface of second layer 220 may contact less than the full surface area corresponding to the distal side of first layer 210. Similarly, the distal surface of second layer 220 can contact less than the full surface area corresponding to the proximal side of third layer 230. In some embodiments, second layer 220 may have a relatively minimal or discontinuous structure relative to the cushioning layers. For purposes of this description and claims, discontinuous sole layer refers to a sole layer that includes breaks or discontinuities within the layer. In some embodiments, the discontinuity can comprise an aperture in the material of the layer. In other embodiments, the discontinuity can comprise regions of material formed only along one side or portion of the layer. In different embodiments, due to the smaller structural dimensions of and/or gaps associated with different sections of second layer 220 (or other stability layers in first sole 204) relative to the cushioning layers, second layer 220 may contact only specific portions of any adjacent cushioning layers (e.g., first layer 210 and/or third layer 230). In some embodiments, an area of second layer 220 may contact less than the full area of an adjacent cushioning layer, for example. Thus, in some embodiments, a proximal side of a cushioning layer may include one or more exposed regions that do not contact a stability layer. Similarly, in some embodiments, a distal side of a cushioning layer may include one or more exposed regions that do not contact a stability layer. In the embodiment of FIGS. 2 and 3, first gap 202 represents one example of a region along which the distal side of first layer 210 may be exposed. Throughout the embodiments described herein (shown throughout FIGS. 1-13), the cushioning layers disposed adjacent to a stability layer may thus include multiple exposed regions that can be similar to first gap 202, though the size and shape of each exposed region can vary significantly.

In some embodiments, second layer 220 may contact at most 75% to 90% of an adjacent cushioning layer. In one embodiment, a stability layer may have contact with only 50% to 60% of an adjacent cushioning layer. In embodiments where a stability layer is comprised of a plurality of discontinuous portions, members, elements, or other segments that are spaced apart, there may be significantly less contact between the stability layer and the cushioning layer. In other words, there may be portions of either the proximal side or distal side of a cushioning layer that do not contact a portion of an adjacent stability layer.

In some embodiments, this substantially parallel spaced-apart arrangement of elements 200 can provide improved responsiveness in first sole 204, as well as increased stability and durability. Furthermore, the specialized arrangement can interact with one or more cushioning layers (here, first layer 210 and third layer 230), providing support while allowing flexibility to remain throughout first sole 204. Flexibility may be provided in part as a result of the breaks (gaps) throughout second layer 220, for example, which can form exposed regions in the adjacent cushioning layer that can bend more freely and/or flex. This configuration may also, for example, more readily distribute forces throughout first sole 204 from heel portion 145 to midfoot portion 125 and to forefoot portion 105. In one embodiment, due to the diagonal orientation of elements 200, first sole 204 may be configured to resist stretch along a direction aligned with both lateral axis 190 as well as a direction aligned with longitudinal axis 180. In some cases, first sole 204 may resist bending in a substantially medial-lateral direction. In one embodiment, torsional rigidity may be increased as a result of the configuration of first sole 204.

However, in other embodiments, each element need not be disposed in a substantially parallel arrangement as illustrated in FIGS. 2 and 3. In other embodiments, elements 200 may be arranged in any configuration, including a substantially lateral, longitudinal, or intersecting arrangement. In other words, elements 200 may have various orientations that differ from those depicted.

Furthermore, the cushioning layers may also vary in thickness in different embodiments. For example, in some embodiments, the thickness of first layer 210 can be less than the thickness of third layer 230. In other words, because of the configuration of the stability layer (second layer 220) that is disposed between first layer 210 and second layer 230, pressure can be dispersed more readily and efficiently, and a user can experience a high degree of comfort with a thinner cushioning layer disposed above the stability layer.

In the embodiments that follow in FIGS. 4-13, the reader may understand that the various features, properties, characteristics, materials, arrangements, and/or responses of each layer as described above with respect to FIGS. 1-3 may be equally applicable to any or each of the layers described. Thus, for example, though a layer may not be specifically described to include a material or feature below, it may be appreciated that the details provided above with respect to FIGS. 1-3 may be incorporated in any of the following embodiments of FIGS. 4-13. Furthermore, each of the embodiments may include fewer cushioning layers or additional cushioning layers. Similarly, each of the embodiments may include fewer or additional stability layers.

In some embodiments, the various embodiments of sole systems described herein can allow the sole structure to disperse pressure in such a way so as to allow a user to experience a more comfortable and consistent cushioning response without requiring layers of great thickness. Because the stability layers of the embodiments described herein may be substantially thin relative to the cushioning layers, and/or may include open regions or gaps in material, any adjacent cushioning layers can be minimized and continue to provide a comfortable moderating sensation and a higher degree of flexibility to a wearer. In addition, the relative thinness of the stability layers in the embodiments described herein may allow a wearer to be lower or closer to a ground surface, while providing an improved sensation of stability and support.

Figure 4:
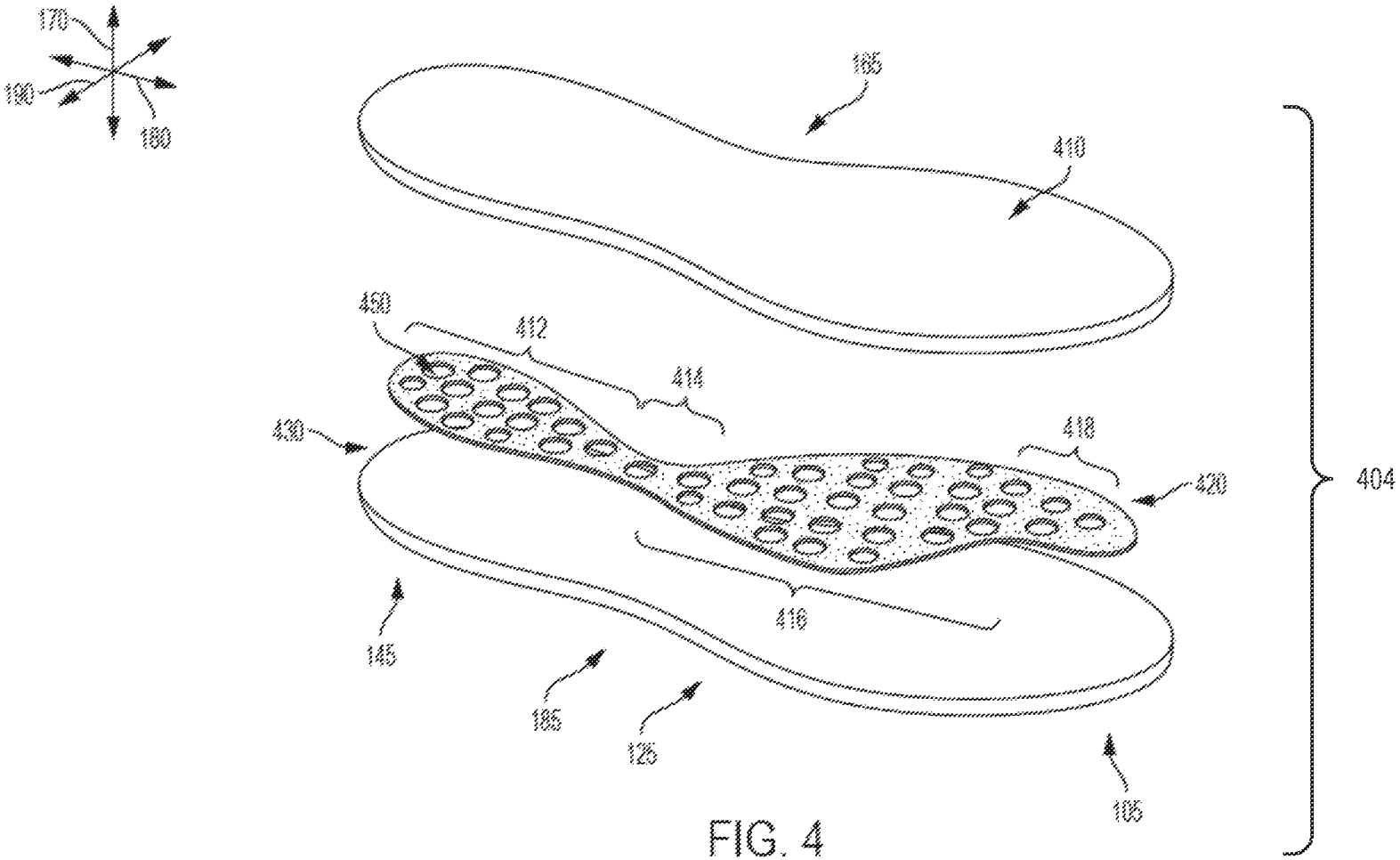
FIG. 4 is an isometric exploded view of an embodiment of a sole structure.
Figure 5:
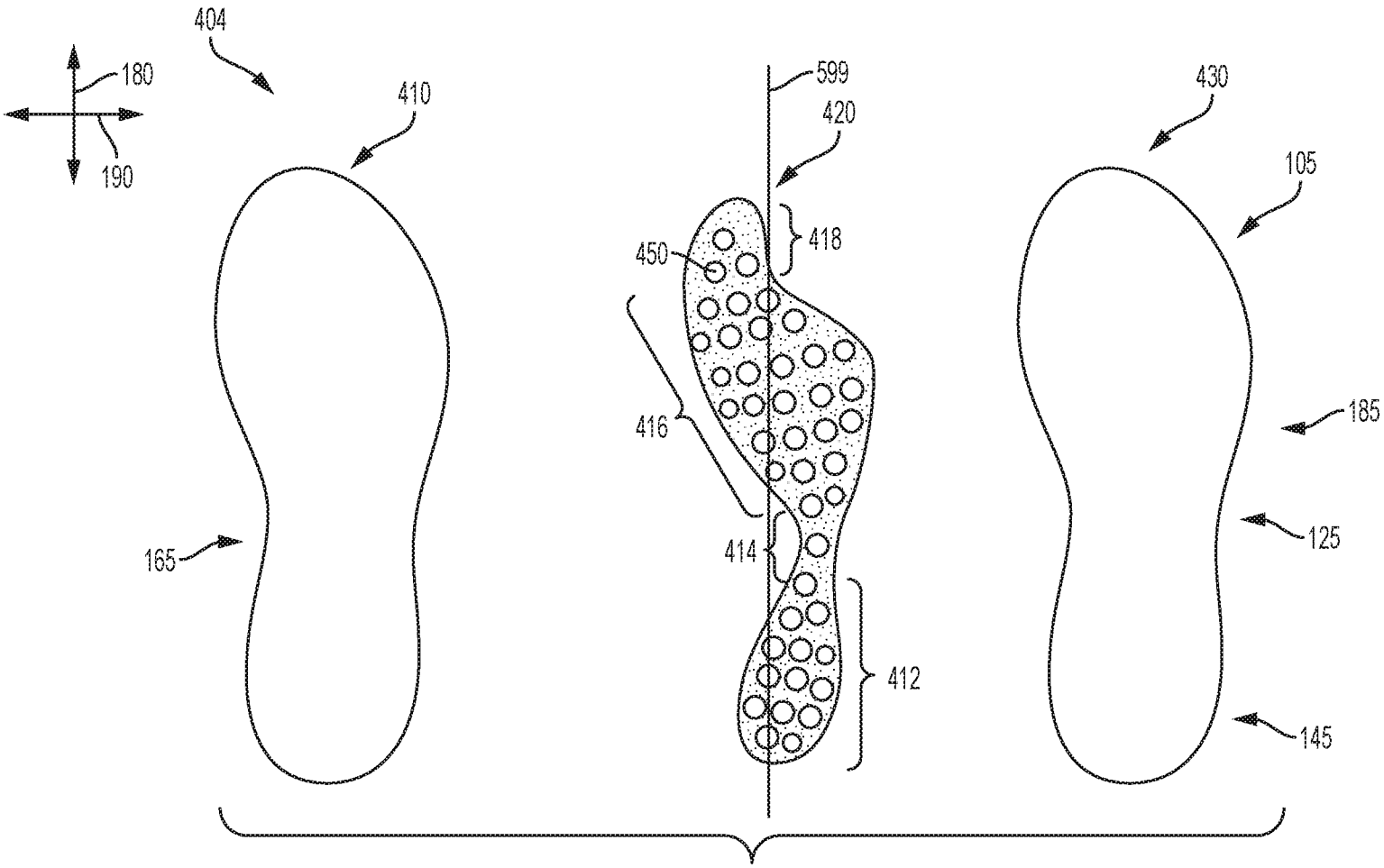
FIG. 5 is a schematic top-down view of an embodiment of some layers of the sole structure of FIG. 4.

Referring now to FIGS. 4 and 5, an embodiment of a second sole structure ("second sole") 404 is depicted, including a first layer 410, a second layer 420, and a third layer 430. In order to provide the reader with greater understanding of the proposed embodiments, two views are depicted of the layers of second sole 404 in FIGS. 4 and 5. In FIG. 4, an isometric exploded view of an embodiment of second sole 404 is illustrated, and in FIG. 5, a top-down exploded view of an embodiment of layers of second sole 404 is illustrated.

In some embodiments, there may be one or more layers that are configured to provide cushioning characteristics to second sole 404. For example, in some embodiments, first layer 410 and/or third layer 430 may comprise cushioning layers, and can be formed of a deformable (for example, compressible) material. In some embodiments, first layer 410 and/or third layer 430 may include any of the cushioning properties described above with respect to first layer 210 or third layer 230 (see FIGS. 2 and 3).

Furthermore, second sole 404 may include a stability layer. The stability layer of second sole 404 can include any of the characteristics or properties described above with respect to second layer 220 (see FIGS. 2 and 3). In FIGS. 4 and 5, second layer 420 can comprise a stability layer, and can help provide a layered structure that can enhance the strength and support for second sole 404.

In different embodiments, the geometry or shape of each layer may be configured to provide specialized support properties to second sole 404. In some embodiments, one or more portions of second layer 420 may have a rectangular, elliptical, round, or an otherwise oblong shape. However, in other embodiments, second layer 420 may include any regular or irregular shape. Furthermore, the perimeter of second layer 420 may include linear sides, curved or rounded sides, or undulating sides. In the embodiment of FIG. 5, second layer 420 comprises a heel segment 412 with a generally teardrop-like shape that is joined through an elongated bridge segment 414 to an oblong midfoot segment 416, which extends forward to join a toe segment 418.

Each segment can have different dimensions in different embodiments. Referring to FIGS. 4 and 5, second layer 420 extends the full length of second sole 404. In other cases, however, second layer 420 could extend through specific portions of second sole 404. In FIGS. 4 and 5, heel segment 412 begins from a rearmost end and narrows in a substantially diagonal direction from medial side 165 toward lateral side 185. As second layer 420 narrows, it joins elongated bridge segment 414, which is seen to be disposed entirely on lateral side 185, such that no portion of second layer 420 is disposed on medial side 165 throughout bridge segment 414. From elongated bridge segment 414, second layer 420 broadens and extends outward toward both medial side 165 and lateral side 185 in oblong midfoot segment 416. As oblong midfoot segment 416 approaches forefoot portion 105, there is again a narrowing of the layer, such that toe segment 418 is disposed only along medial side 165. Therefore, in some embodiments, second layer 420 comprises a substantially continuous but asymmetrical plate structure.

Thus, in different embodiments, different portions of a sole layer or two sole layers may be asymmetrical with respect to one another, relative to a central axis, such as a midline 599 (shown in FIG. 5). For purposes of this description, the term "asymmetrical" and "asymmetric" are used to characterize regions of a sole layer. As used herein, a sole layer has a symmetric configuration when the sole layer is uniform or has a repeated, consistent pattern across the medial side and lateral side, as well as throughout the forefoot portion, midfoot portion, and heel portion. In contrast, a sole layer has an asymmetric configuration when there are regions in the sole layer that have varying structural characteristics relative to another region, or relative to an adjacent sole layer. Some examples are the inclusion of apertures or "spaced-apart" regions in the sole layer that provide discontinuous regions in the sole layer. It may be further understood that the characterizations of symmetric and asymmetric may be with reference to all features of the sole layer, or with reference to only some subset of features. In particular, given a feature of a sole layer, two or more regions of the sole layer may be considered as symmetric or asymmetric only with respect to that feature. It should further be understood that while a sole component or layer may generally include some level of asymmetry, the asymmetry described herein may be primarily directed to any asymmetry in the position and/or orientation of the arrangement of portions of a support or stability layer in the sole structure. Thus, in each of the embodiments depicted in FIGS. 1-12, the stability layers are shown to be substantially asymmetric, while the cushioning layers are substantially symmetric. Furthermore, it can be understood that the stability layer is asymmetric relative to the cushioning layers. In other words, while the cushioning layers extend in a continuous manner from one end of the sole structure (such as the heel portion) to the opposing end (such as the forefoot portion), the stability layer can include one or more breaks or gaps relative to the cushioning layers.

In addition, in some embodiments, the plate comprising a stability layer such as second layer 420 may include one or more of plurality of apertures 450. As shown in FIGS. 4 and 5, a plurality of apertures 450 are arranged throughout each of the segments of second layer 420 in a substantially consistent, repeating arrangement. While the size and/or geometry of the apertures may vary in different embodiments, in other embodiments, plurality of apertures 450 may include a substantially similar geometry and/or size. For example, FIG. 5 depicts plurality of apertures 450 as including substantially similar round or circular shapes that are generally similar in size (i.e., diameter). In some other embodiments, plurality of apertures 450 may have a variety of geometric shapes that may be chosen to impart specific aesthetic or functional properties to a layer. In some embodiments, plurality of apertures 450 may include rectangular, triangular, elliptical, or other regular or irregular shapes. Furthermore, two apertures may differ in both shape and size from one another.

In some embodiments, plurality of apertures 450 can provide means for decoupling or softening portions of a support or stability layer in order to enhance its flexibility or ability to interact with a cushioning layer. Thus, plurality of apertures 450 can be arranged to increase responsiveness, comfort, resilience, shock absorption, elasticity, and/or stability present in a portion of the layer. Furthermore, plurality of apertures 450 can be formed in various portions of a layer to produce regions between adjacent portions of the layer that are better able to articulate or bend with respect to one another.

In some embodiments, the properties associated with second layer 420 may interact with and provide a combined effect with the properties associated with the cushioning layers (first layer 410 and third layer 430) to allow a specialized support response in second sole 404. For example, the varying stiffness associated with second layer 420 may complement or supplement the stiffness that is associated with first layer 410 in order to provide a sole system that is configured for improved stability and cushioning for a wearer. Furthermore, it should be understood that in some other embodiments, there may be one or more segments or portions of second layer 420 that are relatively more rigid than one or more segments of second layer 420, allowing the relative rigidity of each set to vary throughout the layers of second sole 404.

In addition, in some embodiments, first layer 410, second layer 420, and third layer 430 can form a cooperative support system in second sole 404. In some embodiments, this arrangement can provide improved responsiveness in second sole 404, as well as increased stability and durability. Furthermore, second layer 420 can interact with one or more cushioning layers (here, first layer 410 and third layer 430) and allow substantial flexibility to remain throughout second sole 404. This configuration may also, for example, more readily distribute forces throughout second sole 404 from heel portion 145 to midfoot portion 125 and to forefoot portion 105. In one embodiment, torsional rigidity may be increased as a result of the configuration of second sole 404. In another embodiment, due to the regions in which first layer 410 and third layer 430 directly contact one another (areas in which there is no second layer 420) it can be seen that second sole 404 may be configured to have more flexibility in regions where only two cushioning layers—or no support or stability layer material—are present.

Figure 6:
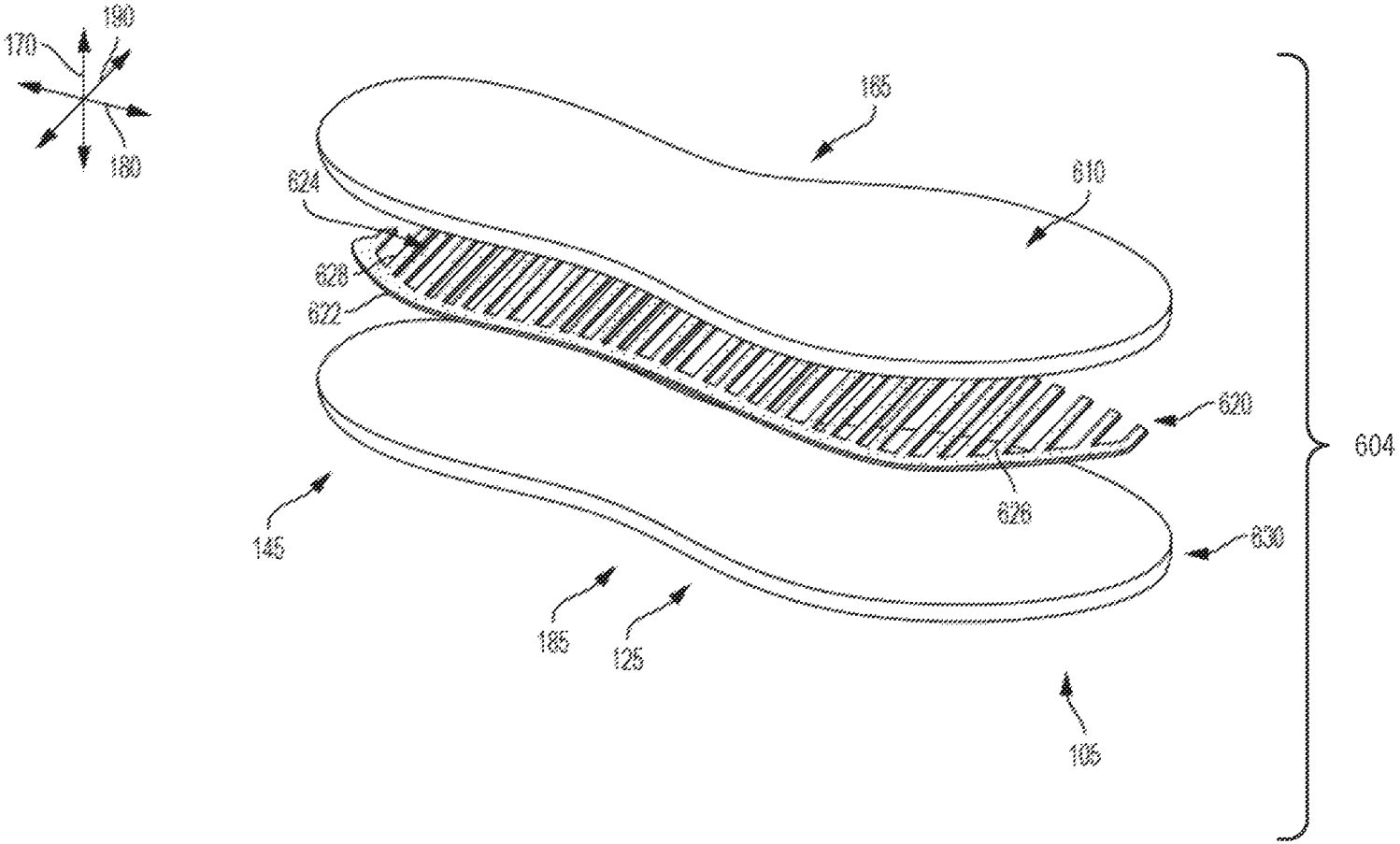
FIG. 6 is an isometric exploded view of an embodiment of a sole structure.
Figure 7:
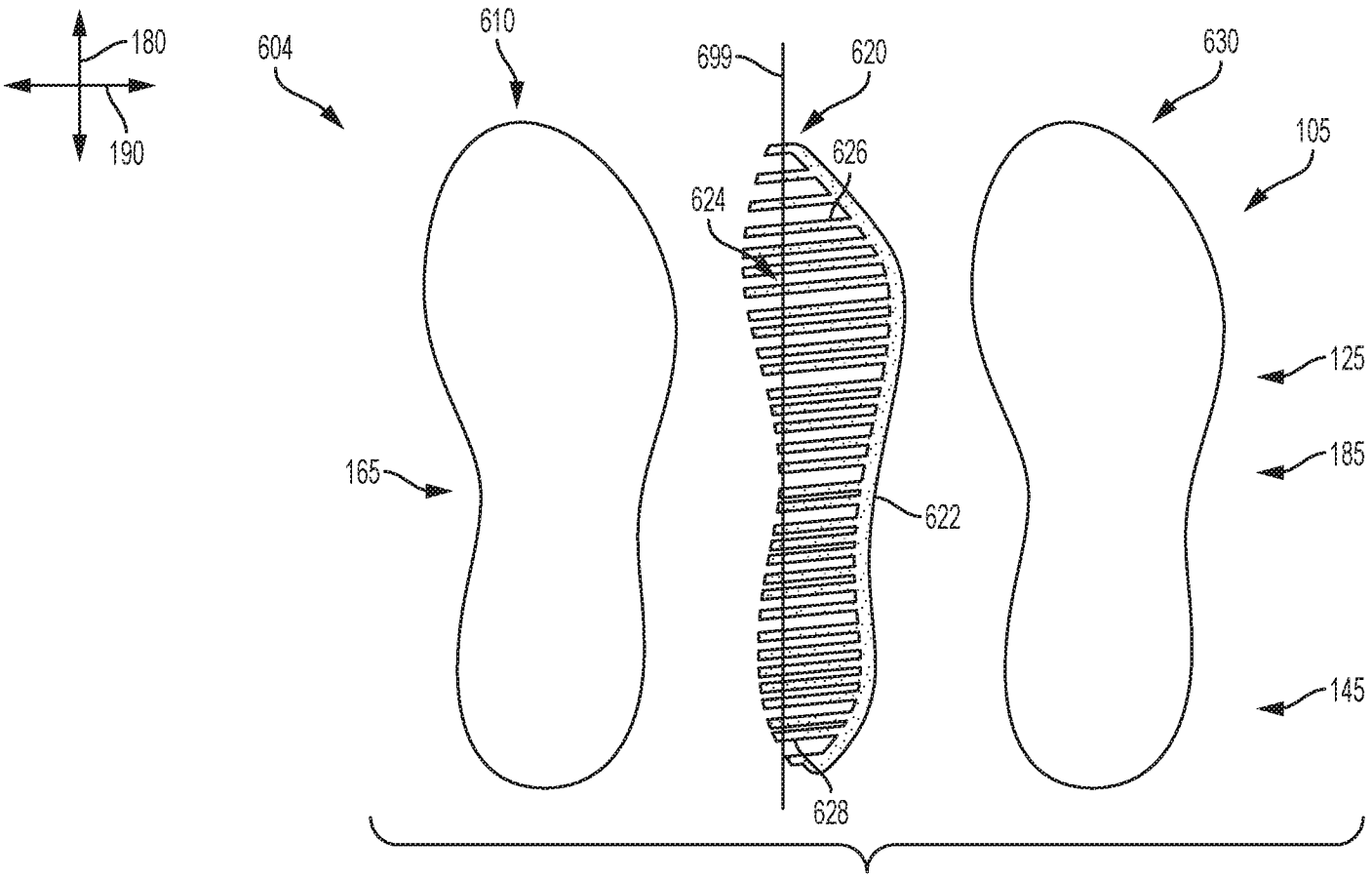
FIG. 7 is a schematic top-down view of an embodiment of some layers of the sole structure of FIG. 6.

Referring now to FIGS. 6 and 7, an embodiment of a third sole structure ("third sole") 604 is depicted, including a first layer 610, a second layer 620, and a third layer 630. In order to provide the reader with greater understanding of the proposed embodiments, two views are depicted of the layers of third sole 604 in FIGS. 6 and 7. In FIG. 6, an isometric exploded view of an embodiment of third sole 604 is illustrated, and in FIG. 7, a top-down exploded view of an embodiment of the layers of third sole 604 is illustrated.

In some embodiments, there may be one or more layers that are configured to provide cushioning characteristics to third sole 604. For example, in some embodiments, first layer 610 and/or third layer 630 may be cushioning layers, and can be formed of a deformable (for example, compressible) material. In some embodiments, first layer 610 and/or third layer 630 may include any of the cushioning properties described above with respect to first layer 210 and/or third layer 230 (see FIGS. 2 and 3).

Furthermore, third sole 604 may include a stability layer. The stability layers of third sole 604 can include any of the characteristics or properties described above with respect to second layer 220 (see FIGS. 2 and 3). In FIGS. 6 and 7, second layer 620 can comprise a stability layer that can help provide a layered structure which can improve strength and support in third sole 604.

In different embodiments, the geometry or shape of each layer may be configured to provide specialized support properties to third sole 604. In some embodiments, one or more portions of second layer 620 may have a rectangular, elliptical, round, or an otherwise oblong shape. However, in other embodiments, second layer 620 may include any regular or irregular shape. Furthermore, the perimeter of second layer 620 may include linear sides, curved or rounded sides, or undulating sides. In the embodiment of FIG. 7, second layer 620 comprises a generally continuous curved and elongated backbone segment 622, or simply backbone segment 622, extending along the edge of third sole 604 associated with lateral side 185. In other words, in some embodiments, backbone segment 622 can extend along a portion of the perimeter corresponding with an outer lateral edge of third sole 604. Therefore, in some embodiments, second layer 620 comprises substantially discontinuous, asymmetrical plate structure joined to a continuous, asymmetric segment.

In some embodiments, backbone segment 622 may extend throughout a substantial majority of the length of third sole 604. However, in other embodiments, backbone segment 622 may be disposed in only some portions of third sole 604. Furthermore, in some embodiments, there may be members 624 extending from backbone segment 622 toward medial side 165. In some embodiments, members 624 may comprise a substantially elongated and linear geometry. Each member may have different dimensions in some embodiments.

Referring to FIGS. 6 and 7, a first member 626 disposed along forefoot portion 105 is longer than a second member 628 disposed in heel portion 145. In some embodiments, the length of a member may extend the full width of second layer 620. In other embodiments, as shown in FIG. 7, members have a length smaller than that of the maximum width of second layer 620. Thus, in some embodiments, second layer 620 may be positioned such that a substantial majority of second layer 620 is disposed along lateral side 185. However, in other embodiments, second layer 620 may be "flipped" along a midline 699 aligned with longitudinal axis 180, such that a substantial majority of second layer 620 is disposed along medial side 165 instead, and backbone segment 622 is disposed along the perimeter associated with the edge of medial side 165 of third sole 604.

Thus, in one embodiment, second layer 620 extends the full length of third sole 604. In other cases, however, second layer 620 could extend through only specific portions of third sole 604 in order to help modify or tailor the stiffness of third sole 604. In addition, members 624 extend in a direction aligned with lateral axis 190 in a generally uniform manner throughout the length of second layer 620, where at least a majority of members 624 are spaced apart at regular intervals and/or are arranged in a substantially parallel manner relative to one another. However, in other embodiments, members 624 may be spaced further apart in some regions relative to other regions of third sole 604. Furthermore, some portions of second layer 620 may not include any members 624 in other embodiments. In addition, in some embodiments, members 624 may not be parallel relative to one another.

In some embodiments, the arrangement of members 624, and in particular the spacing between members 624, can provide means for decoupling or softening portions of a support or stability layer in order to enhance its flexibility or ability to interact with a cushioning layer. Thus, members 624 can be arranged to increase responsiveness, comfort, resilience, shock absorption, elasticity, and/or stability present in a portion of the layer. Furthermore, gaps separating one member from another adjacent member can be formed in various portions of a layer to produce regions between adjacent portions of the layer that are better able to articulate or bend with respect to one another. Thus, in the embodiment of FIG. 7, bending may be facilitated in a direction aligned with longitudinal axis 180, while relatively inhibited in a direction aligned with lateral axis 190.

As shown, in FIGS. 6 and 7, the relative rigidity associated with portions or segments of second layer 620 may be configured to modify, tune, or otherwise adjust the overall stability, flexibility, and structural support through third sole 604. Specifically, in some embodiments, the properties associated with the cushioning layers (first layer 610 and third layer 630) may interact with and provide a combined effect with the properties associated with second layer 620 to allow a specialized support response in third sole 604. Furthermore, within the same layer, there may also be portions that are relatively less rigid than another portion, allowing the relative rigidity of each set to vary throughout the layers of third sole 604. In another embodiment, due to the partial overlap of first layer 410 and third layer 430 (where first layer 410 and third layer 430 are in direct contact with each other), third sole 604 may be configured to have greater flexibility in regions where only the cushioning layers—or no support or stability layer material—are present.

Figure 8:
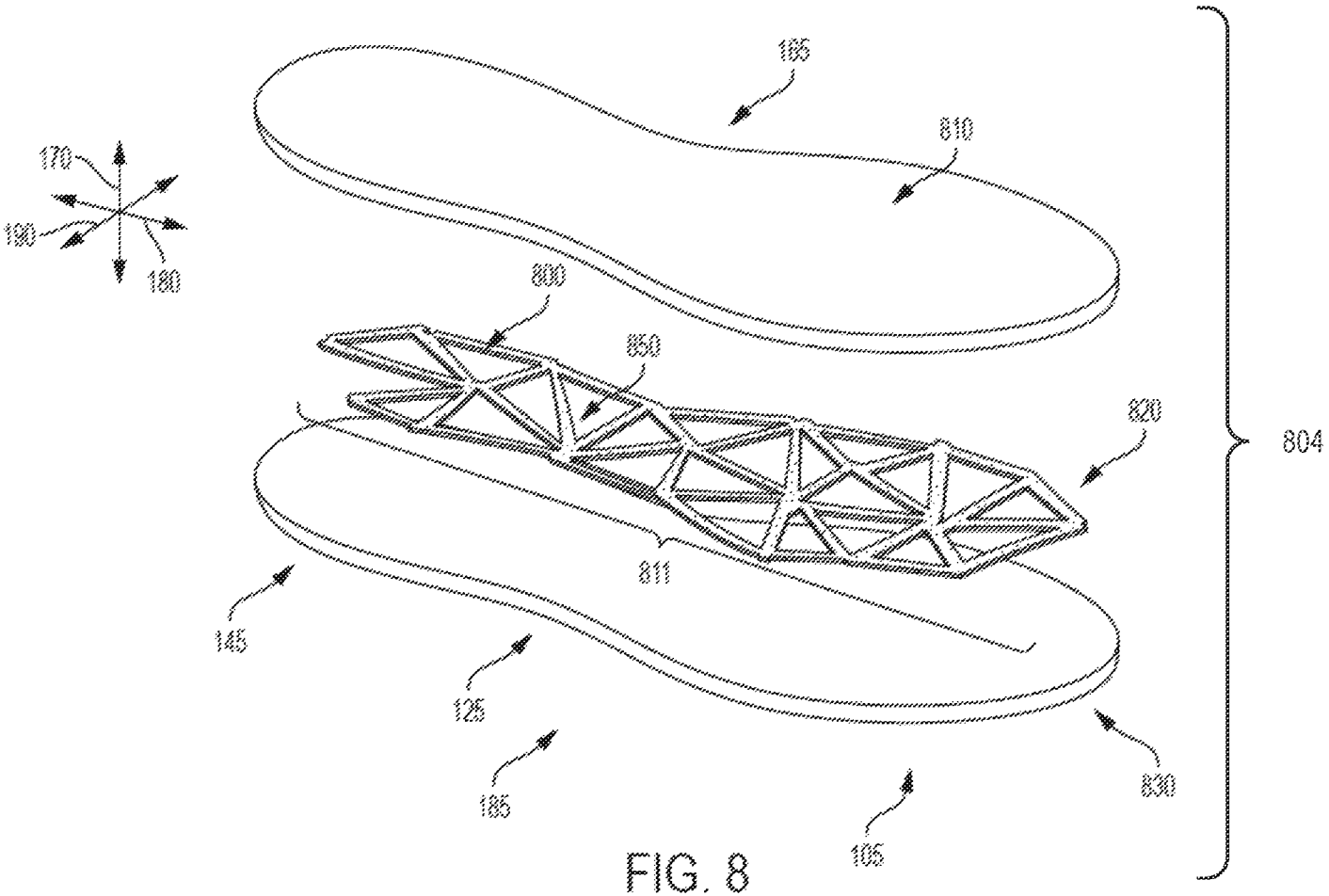
FIG. 8 is an isometric exploded view of an embodiment of a sole structure.
Figure 9:
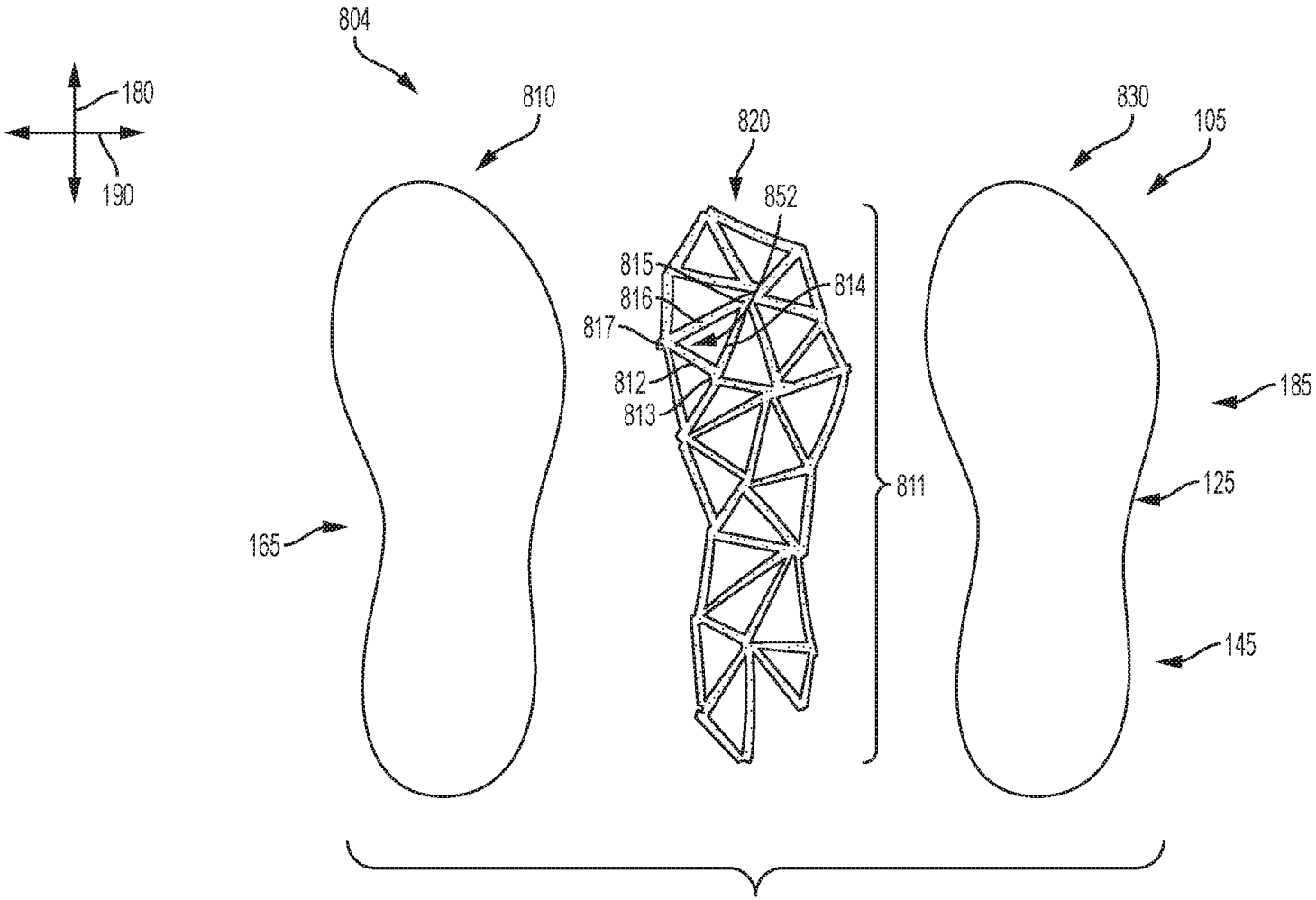
FIG. 9 is a schematic top-down view of an embodiment of some layers of the sole structure of FIG. 8.

Referring now to FIGS. 8 and 9, an embodiment of a fourth sole structure ("fourth sole") 804 is depicted, including a first layer 810, a second layer 820, and a third layer 830. In order to provide the reader with greater understanding of the proposed embodiments, two views are depicted of the layers of fourth sole 804 in FIGS. 8 and 9. In FIG. 8, an isometric exploded view of an embodiment of fourth sole 804 is illustrated, and in FIG. 9, a top-down exploded view of an embodiment of layers of fourth sole 804 is illustrated.

In some embodiments, there may be one or more layers that are configured to provide cushioning characteristics to fourth sole 804. For example, in some embodiments, first layer 810 and/or third layer 830 may comprise cushioning layers, and can be formed of a deformable (for example, compressible) material. In some embodiments, first layer 810 and/or third layer 830 may include any of the cushioning properties described above with respect to first layer 210 and/or third layer 230 (see FIGS. 2 and 3).

Furthermore, fourth sole 804 may include a stability layer. The stability layers of fourth sole 804 can include any of the characteristics or properties described above with respect to second layer 220 (see FIGS. 2 and 3). In FIGS. 8 and 9, second layer 820 can comprise a stability layer, and can help provide a layered structure that can improve strength and support for fourth sole 804.

In the embodiment of FIG. 9, it can be seen that second layer 820 can comprise a scaffolding-like structure, with a plurality of substantially elongated and relatively linear members 800, or simply members 800, arranged about forefoot portion 105, midfoot portion 125, and heel portion 145. However, it should be understood that members 800 of second layer 820 may not necessarily be linear, and can include curved, rounded, or undulating edges in some embodiments. In different embodiments, members 800 can be arranged to intersect and define the boundaries of different shapes, where the shapes can comprise a hollow, apertured, or otherwise discontinuous interior area, identified herein as apertures 850. As shown in FIG. 9, in some embodiments, second layer 820 can include a plurality of the substantially rigid members 800 that are configured to increase stability for fourth sole 804. The sizes (i.e., lengths) and thickness of members 800 may be varied in different embodiments to achieve a desired degree of support for fourth sole 804. For purposes of reference, second layer 820 comprises a first set 811 of members 800. Members 800 may be integrally joined in some embodiments, or members 800 may be otherwise bonded or attached to each other in other embodiments. Therefore, in some embodiments, second layer 820 comprises a substantially discontinuous, asymmetrical plate structure.

The geometry or shapes resulting from the intersection of the various members 800 may be configured to provide specialized support properties to fourth sole 804 in different embodiments. In some embodiments, one or more portions of second layer 820 may include a triangular, square, rectangular, elliptical, oblong, round, pentagonal, hexagonal, heptagonal, octagonal, or an otherwise substantially polygonal shape bounding an aperture. However, in other embodiments, second layer 820 may include any regular or irregular shapes. In some cases, there may be repeating arrangements of shapes. In other cases, the shapes formed can share multiple member sides with neighboring shapes or apertures 850.

In different embodiments, first set 811 may each include at least three members 800. In some embodiments, first set 811 may each include between 10 and 60 members. In the embodiment of FIGS. 8 and 9, first set 811 comprises approximately 42 members.

For purposes of reference, in FIG. 9, a first member 812, a second member 814, and a third member 816 are identified in second layer 820. First member 812 intersects or is joined to second member 814 at a first intersection 813, second member 814 intersects or is joined to third member 816 at a second intersection 815, and third member 816 intersects or is joined to first member 812 at a third intersection 817. Thus, it can be seen that first member 812, second member 814, and third member 816 are arranged to form a triangular shape bounding or defining a first aperture 852. In other embodiments, as noted above, different geometries may result from the various arrangements and intersections of members 800. For example, a second aperture 854 is bounded by five members formed in third layer 830 and comprises a substantially pentagonal shape.

Thus, each intersection may join together multiple members in some embodiments. In the embodiment illustrated in FIG. 9 for example, first intersection 813 provides a junction to four members, forming a kind of spoke portion in forefoot portion 105 along second layer 820, where each member can radiate outward from first intersection 813. In some embodiments, portions of each member may be integrally formed with and/or fixedly attached to a portion of an adjacent member. In other embodiments, however, different members may not be integrally formed, and/or there could be loose or unanchored members comprising first set 811.

In some embodiments, members 800 of second layer 820 may be arranged throughout the full length and/or width of fourth sole 804. In other cases, however, members 800 of second layer 820 could extend through only specific portions of fourth sole 804. As shown in FIGS. 8 and 9, the members of first set 811 are arranged throughout forefoot portion 105, midfoot portion 125, and heel portion 145. In some embodiments, members 800 of second layer 820 can extend or be disposed on both lateral side 185 and medial side 165 over at least some portions of fourth sole 804. In FIGS. 8 and 9, members 800 of first set 811 are arranged along both lateral side 185 and medial side 165 throughout the length of first layer 810.

In different embodiments, each member element can differ in length or thickness from other members in first set 811. Thus, in some embodiments, the dimensions (including length, width, area, and/or thickness) of each member may be configured to provide specific support responses to fourth sole 804. In some embodiments, a member may be longer, thicker, or wider in a first region of second layer 820 relative to another (second) region in order to provide a wearer with greater stability in the first region. In another embodiment, members 800 may be more closely arranged to provide greater stability. For example, there may be a higher density of members 800 in heel portion 145 relative to other portions in order to provide increased support to the heel if desired.

Furthermore, the intersection or junctions between portions of the members can produce regions of second layer 820 that permit articulation or bending with respect to one another. In addition, the varying sizes of the areas associated with apertures 850 can provide fourth sole 804 with increased flexibility in fourth sole 804. As shown in FIGS. 8 and 9, plurality of apertures 850 are arranged in a generally consistent manner throughout second layer 820. While the size and/or geometry of the apertures may vary in different embodiments, as noted above, in other embodiments, apertures 850 may include a substantially similar geometry and/or size. For example, FIG. 9 depicts apertures 850 as including a substantially similar triangular shape that are generally similar in size (i.e., area).

In some embodiments, apertures 850 can provide means for decoupling or softening portions of a support or stability layer in order to enhance its flexibility or ability to interact with a cushioning layer. Thus, apertures 850 can be arranged to increase responsiveness, comfort, resilience, shock absorption, elasticity, and/or stability present in a portion of the layer. Furthermore, apertures 850 can be formed in various portions of a layer to produce regions between adjacent portions of the layer that are better able to articulate or bend with respect to one another.

In addition, the relative rigidity associated with portions or members of second layer 820 may be configured to modify, tune, or otherwise adjust the overall stability, flexibility, and structural support through fourth sole 804. Specifically, in some embodiments, the properties associated with second layer 820 may interact with and provide a combined effect with the properties associated with first layer 810 and third layer 830 to allow a specialized support response in fourth sole 804. For example, the varying stiffness associated with second layer 820 may complement or supplement the flexibility that is associated with the cushioning layers in order to provide a sole system that is configured for improved stability and cushioning for a wearer. Furthermore, within the same layer, there may also be portions that are relatively less rigid than another portion, allowing the relative rigidity of each set to vary throughout the layers of fourth sole 804.

In addition, in some embodiments, first layer 810, second layer 820, and third layer 830 can form a cooperative support system in fourth sole 804. In some embodiments, this arrangement can provide improved responsiveness in fourth sole 804, as well as increased stability and durability. Furthermore, the arrangement can interact with one or more cushioning layers (here, first layer 810 and third layer 830)

and allow substantial flexibility to remain throughout fourth sole 804. This configuration may also, for example, more readily distribute forces throughout fourth sole 804 from heel portion 145 to midfoot portion 125 and to forefoot portion 105. In one embodiment, torsional rigidity may be increased as a result of the configuration of fourth sole 804. In another embodiment, due to the partial overlap of first layer 810 and third layer 830 (where first layer 810 directly contacts third layer 830), fourth sole 804 may be configured to have greater flexibility in regions where only two cushioning layers—or no support or stability layer material—are present.

Figure 10:
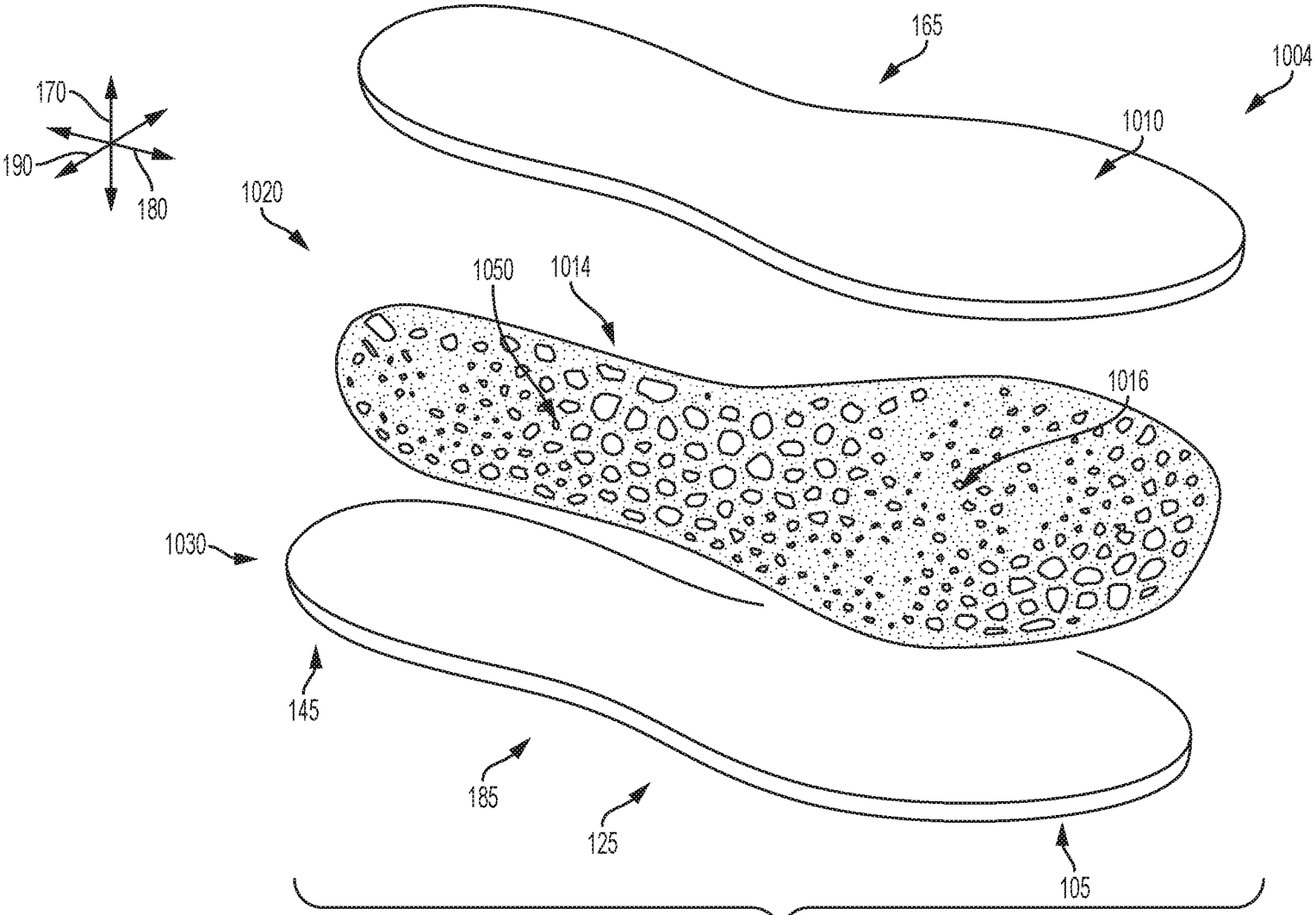
FIG. 10 is an isometric exploded view of an embodiment of a sole structure.
Figure 11:
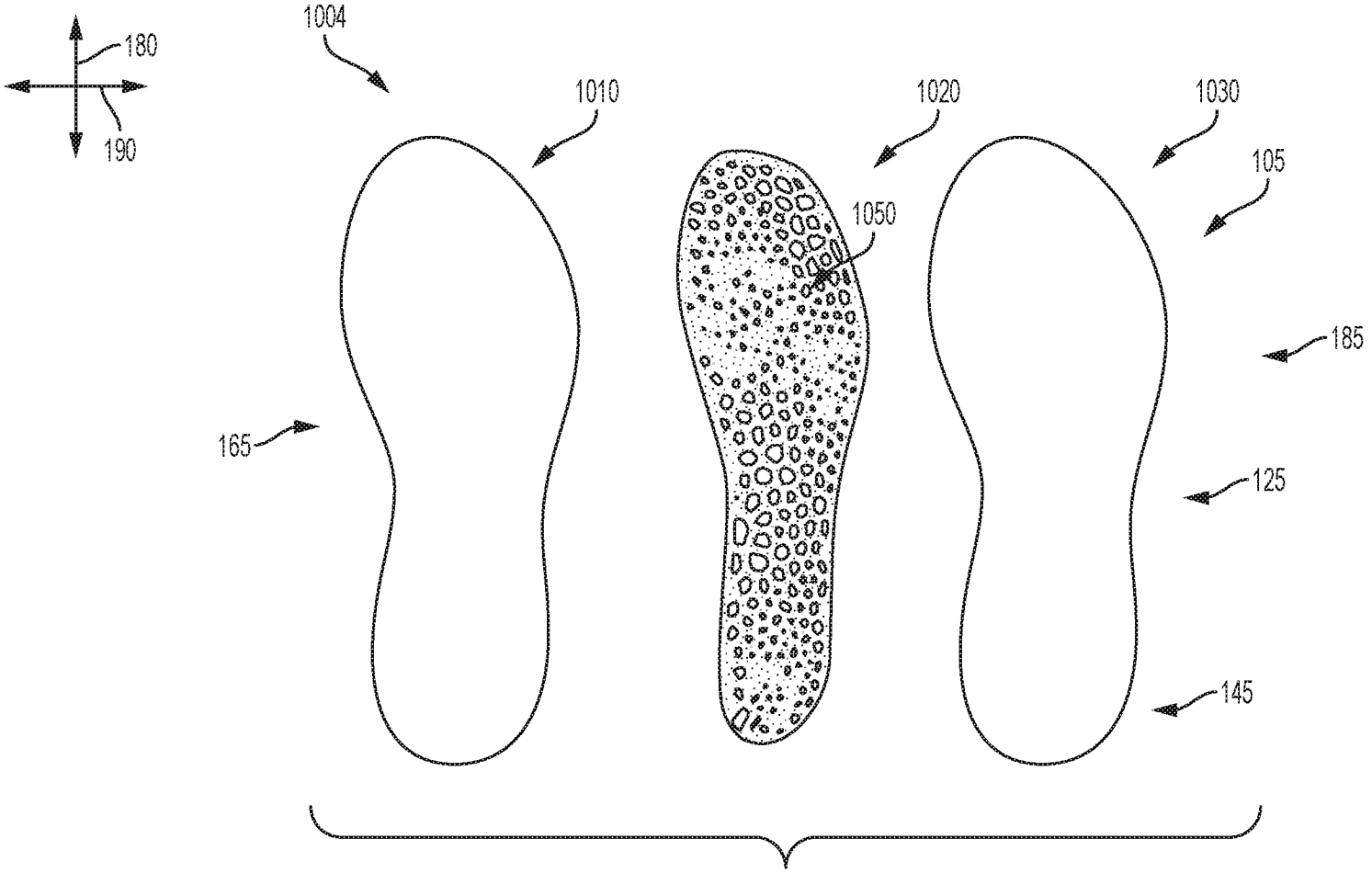
FIG. 11 is a schematic top-down view of an embodiment of some layers of the sole structure of FIG. 10.

Referring now to FIGS. 10 and 11, an embodiment of a fifth sole structure ("fifth sole") 1004 is depicted, including a first layer 1010, a second layer 1020, and a third layer 1030. In order to provide the reader with greater understanding of the proposed embodiments, two views are depicted of the layers of fifth sole 1004 in FIGS. 10 and 11. In FIG. 10, an isometric exploded view of an embodiment of fifth sole 1004 is illustrated, and in FIG. 11, a top-down exploded view of an embodiment of layers of fifth sole 1004 is illustrated. It should be understood that while the view in FIG. 10 of second layer 1020 is oriented facing the viewer for purposes of illustration and clarity to the reader, the layers are assembled as discussed above with respect to FIGS. 1-9.

In some embodiments, there may be one or more layers that are configured to provide cushioning characteristics to fifth sole 1004. For example, in some embodiments, first layer 1010 and/or third layer 1030 may be cushioning layers, and can be formed of a deformable (for example, compressible) material. In some embodiments, first layer 1010 and/or third layer 1030 may include any of the cushioning properties described above with respect to first layer 210 and/or third layer 230 (see FIGS. 2 and 3).

Furthermore, fifth sole 1004 may include multiple stability layers. The stability layer of fifth sole 1004 can include any of the characteristics or properties described above with respect to second layer 220 (see FIGS. 2 and 3). In FIGS. 10 and 11, second layer 1020 can comprise a stability layer that provide a layered structure that may be configured to improve strength and support for fifth sole 1004.

Thus, in different embodiments, the geometry or shape of each layer may be configured to provide specialized support properties to fifth sole 1004. In some embodiments, one or more portions or segments of second layer 1020 may have a rectangular, elliptical, round, or an otherwise oblong shape. However, in other embodiments, second layer 1020 may include any regular or irregular shape. Furthermore, the perimeter of second layer 1020 may include linear sides, curved or rounded sides, or undulating sides.

Referring now to second layer 1020 as depicted in FIGS. 10 and 11, it can be seen that a support or stability layer may be configured to include a plurality of apertures 1050 arranged throughout a substantial majority of second layer 1020. Plurality of apertures 1050 can be varying shapes and sizes in different embodiments. For example, in FIG. 10, it can be seen that in a first region 1014 along midfoot portion 125, the apertures are generally larger than the apertures formed in a second region 1016 toward forefoot portion 105. The varying sizes of each aperture can provide greater cushioning in some regions (such as where apertures are relatively larger in area), while the relatively smaller apertures may have decreased cushioning associated with that region. Thus, in some embodiments, first region 1014 may be substantially less rigid than second region 1016. Plurality of apertures 1050 can allow portions of the adjacent cushioning layers to interact and provide a wearer with a greater sensation of comfort in some embodiments. Therefore, in some embodiments, second layer 1020 comprises a substantially discontinuous, asymmetrical plate structure.

In addition, in FIGS. 10 and 11, the relative rigidity associated with portions or segments of second layer 1020 may be configured to modify, tune, or otherwise adjust the overall stability, flexibility, and structural support through fifth sole 1004. Specifically, in some embodiments, the properties associated with second layer 1020 may interact with and provide a combined effect with the properties associated with first layer 1010 and third layer 1030 to allow a specialized support response in fifth sole 1004. For example, the varying stiffness associated with second layer 1020 may complement or supplement the deformability and flexibility that is associated with first layer 1010 and third layer 1030 in order to provide a sole system that is configured for improved stability and cushioning for a wearer. For example, due to the substantial area near the center of fifth sole 1004 where second layer 1020 includes larger apertures (first region 1014) fifth sole 1004 may facilitate bending in the forefoot-heel direction. Furthermore, within the same layer, there may also be portions that are relatively less rigid than another portion, allowing the relative rigidity of each set to vary throughout the layers of fifth sole 1004.

In addition, in some embodiments, first layer 1010, second layer 1020, and third layer 1030 can form a cooperative support system in fifth sole 1004. In some embodiments, this arrangement can provide improved responsiveness in fifth sole 1004, as well as increased stability and durability. Furthermore, the arrangement can interact with one or more cushioning layers (here, first layer 1010 and third layer 1030) and allow substantial flexibility to remain throughout fifth sole 1004. This configuration may also, for example, more readily distribute forces throughout fifth sole 1004 from heel portion 145 to midfoot portion 125 and to forefoot portion 105. In one embodiment, torsional rigidity may be increased as a result of the configuration of fifth sole 1004. In another embodiment, due to the partial overlap of first layer 1010 and third layer 1030 (where first layer 1010 and third layer 1030 can directly contact each other), fifth sole 1004 may be configured to be more rigid in regions of overlap, while having greater flexibility in regions where only a single layer—or no support or stability layer material—is present.

Figure 12:
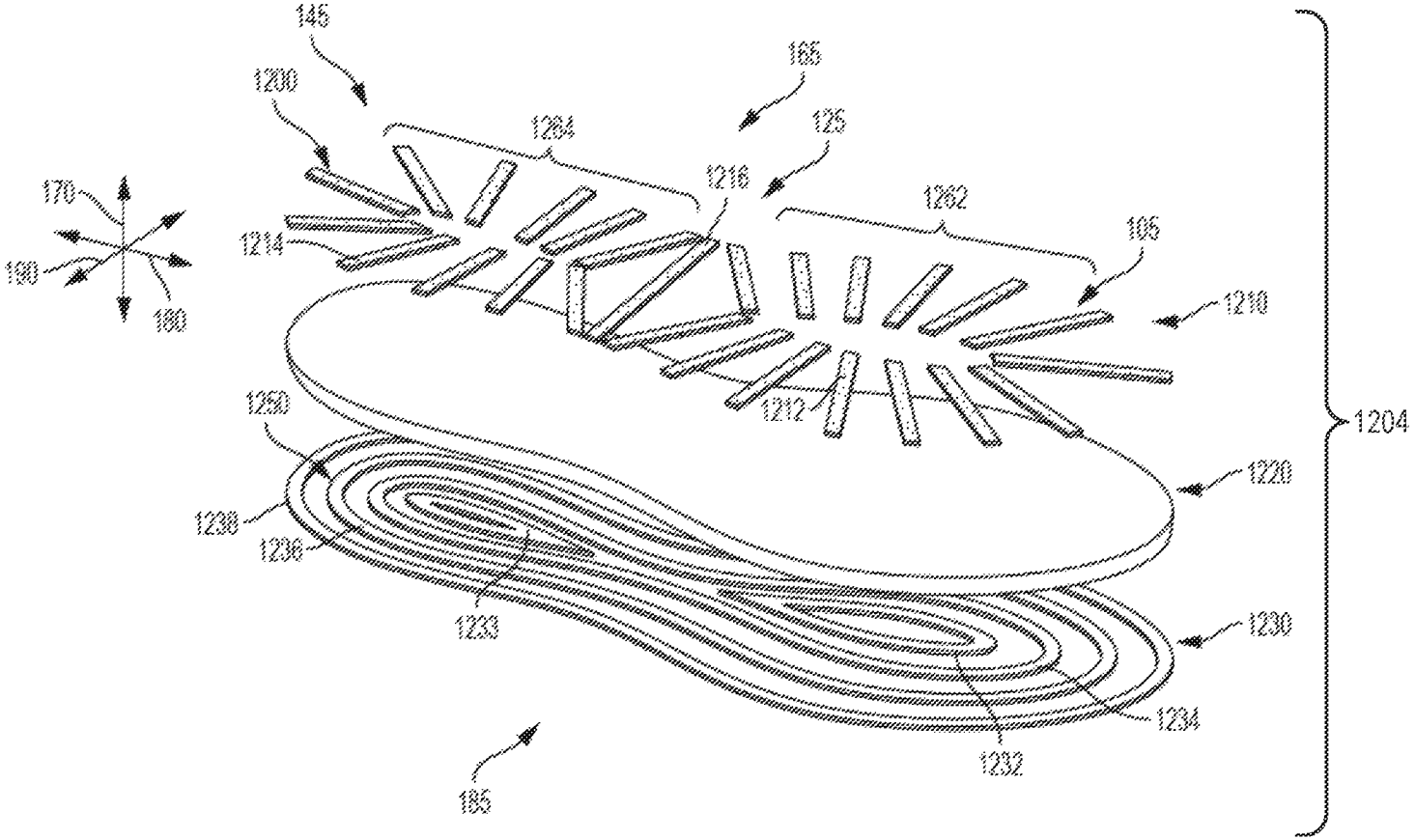
FIG. 12 is an isometric exploded view of an embodiment of a sole structure.
Figure 13:
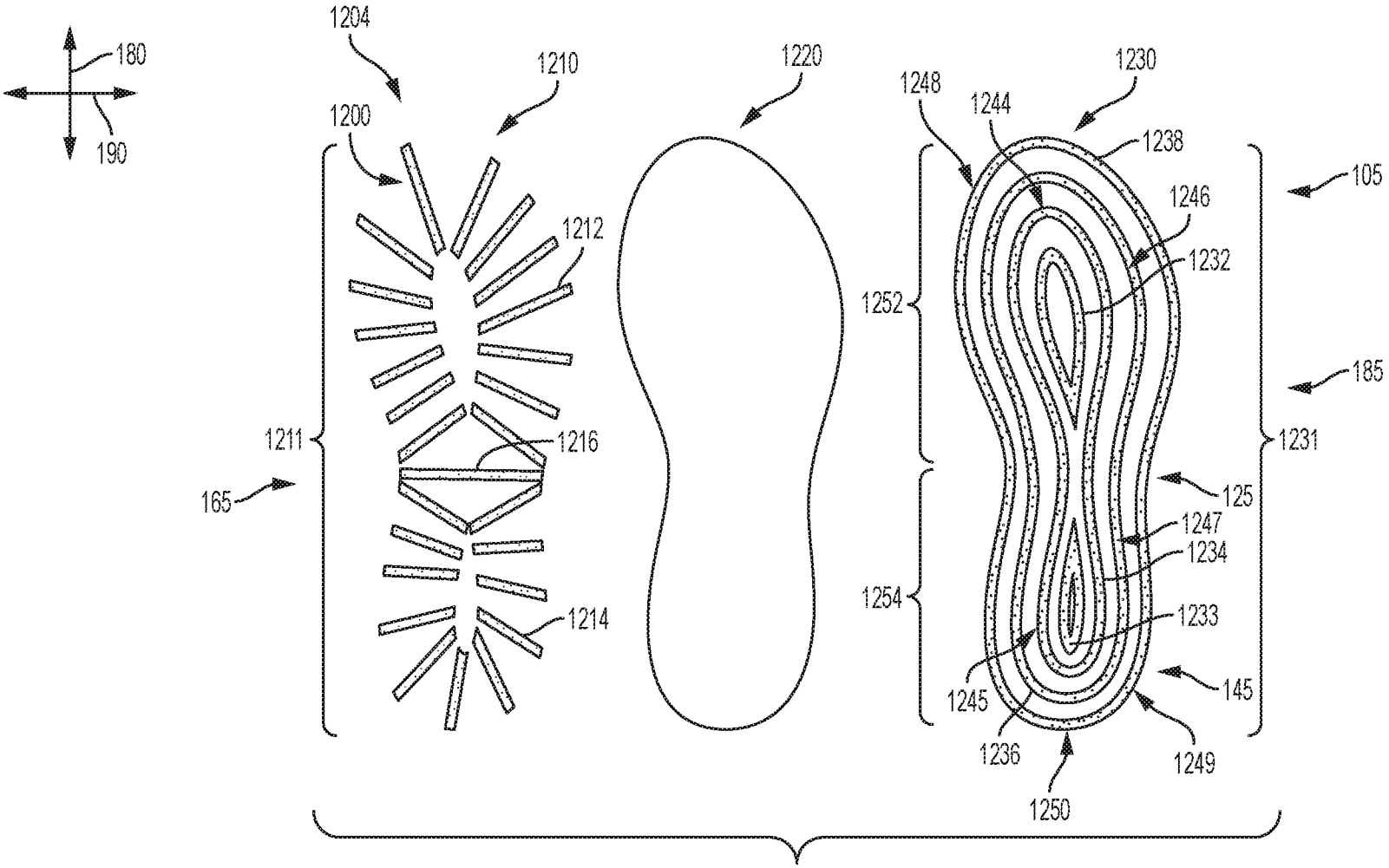
FIG. 13 is a schematic top-down view of an embodiment of some layers of the sole structure of FIG. 12.

Referring now to FIGS. 12 and 13, an embodiment of a sixth sole structure ("sixth sole") 1204 is depicted, including a first layer 1210, a second layer 1220, and a third layer 1230. In order to provide the reader with greater understanding of the proposed embodiments, two views are depicted of the layers of sixth sole 1204 in FIGS. 12 and 13. In FIG. 12, an isometric exploded view of an embodiment of sixth sole 1204 is illustrated, and in FIG. 13, a top-down exploded view of an embodiment of layers of sixth sole 1204 is illustrated.

In some embodiments, there may be one or more layers that are configured to provide cushioning characteristics to sixth sole 1204. For example, in some embodiments, second layer 1220 may be a cushioning layer, and can be formed of a deformable (for example, compressible) material. In some embodiments, second layer 1220 may include any of the cushioning properties described above with respect to first layer 210 and/or third layer 230 (see FIGS. 2 and 3).

Furthermore, sixth sole 1204 may include multiple stability layers. The stability layers of sixth sole 1204 can include any of the characteristics or properties described above with respect to second layer 220 (see FIGS. 2 and 3).

In FIGS. 12 and 13, first layer 1210 and third layer 1230 can comprise stability layers and provide a layered structure that can improve strength and support for sixth sole 1204.

In the embodiment of FIG. 13, it can be seen that either or both of first layer 1210 and third layer 1230 can comprise a "framework"-like structure. First layer 1210 includes a plurality of substantially elongated and relatively linear members 1200, or simply members 1200, arranged throughout forefoot portion 105, midfoot portion 125, and heel portion 145. In different embodiments, members 1200 can be arranged to intersect. Furthermore, third layer 1230 can include plurality of substantially rounded or curved concentric irregular shapes, referred to herein as rings 1250. Members 1200 and rings 1250 can be configured to increase stability for sixth sole 1204 in one embodiment. The sizes (i.e., lengths) and thickness of members 1200 and/or rings 1250 may be varied in different embodiments to achieve a desired degree of additional support for sixth sole 1204. Furthermore, members 1200 of first layer 1210 may not necessarily be linear, and can include ridged, curved, textured, rounded, or undulating edges in some embodiments.

In different embodiments, first layer 1210 may include at least two members 1200. In some embodiments, first layer 1210 includes between five and 50 members. In the embodiment of FIGS. 12 and 13, first layer 1210 comprises approximately 26 members. Furthermore, third layer 1230 may include at least one ring in some embodiments. In some embodiments, third layer 1230 includes between two and 10 rings 1250. In FIGS. 12 and 13, it can be seen that third layer 1230 comprises five rings 1250, including a first ring 1232, a second ring 1233, a third ring 1234, a fourth ring 1236, and a fifth ring 1238. First ring 1232 comprises a general center or middle region of an upper portion 1252 (see FIG. 13) of sixth sole 1204, while second ring 1233 comprises a general center or middle region of a lower portion 1254 (see FIG. 13) of sixth sole 1204. First ring 1232 and second ring 1233 may each have a substantially teardrop-like shape in some embodiments, comprising a rounded end and a tapered end.

In some embodiments, one or more of the remaining rings (i.e., third ring 1234, fourth ring 1236, and fifth ring 1238) may be formed to extend around, surround, encapsulate, or otherwise bound both first ring 1232 and second ring 1233. However, in other embodiments, there may be additional rings 1250 disposed only in upper portion 1252 or lower portion 1254 (see FIG. 13). In FIG. 13, third ring 1234 includes a first rounded portion 1244 disposed in upper portion 1252 that is joined to a second rounded portion 1245 that is disposed in lower portion 1254. In addition, fourth ring 1236 includes a third rounded portion 1246 disposed in upper portion 1252 and a fourth rounded portion 1247 disposed in lower portion 1254. Similarly, fifth ring 1238 includes a fifth rounded portion 1248 disposed in upper portion 1252 and a sixth rounded portion 1249 disposed in with lower portion 1254. Thus, it can be seen that first rounded portion 1244, third rounded portion 1246, and fifth rounded portion 1248 extend substantially around (or surround) first ring 1232, while second rounded portion 1245, fourth rounded portion 1247, and sixth rounded portion 1249 extend substantially around (or surround) second ring 1233.

In different embodiments, when the overlay or stacking between first layer 1210 and third layer 1230 occurs in assembled sixth sole 1204, there may be a plurality of members 1200 disposed in either or both of upper portion 1252 and lower portion 1254. In some embodiments, the number of members 1200 arranged along upper portion 1252 may be greater than, equal to, or less than the number of members arranged in lower portion 1254. In FIG. 13, it can be seen that there are fewer members 1200 in lower portion 1254 than in upper portion 1252.

Furthermore, in some embodiments, members 1200 of first layer 1210 can be arranged to form specific patterns that may complement the pattern of third layer 1230. For example, in FIG. 12, it can be seen that members of first set 1262 of members 1200 are disposed such that they generally radiate outwardly from a first center of an upper portion. The first center can correspond to the position of first ring 1232 in some embodiments when each layer is viewed as a stacked arrangement (i.e., in an assembled sole). Furthermore, and members of second set 1264 of members 1200 are disposed such that they generally radiate outward from a second center of a lower portion. The second center can correspond to the position of second ring 1233 in some embodiments when each layer is viewed as a stacked arrangement (i.e., in an assembled sole). In other embodiments, members 1200 may radiate outward from or otherwise overlap with other portions of different rings (i.e., third ring 1234, fourth ring 1236, and fifth ring 1238) when sixth sole 1204 is assembled.

In different embodiments, each member can differ in length, thickness, or materials from other members in first layer 1210. Similarly, the material or dimensions comprising one ring can differ from other rings. Thus, in some embodiments, the dimensions (including length, width, area, and/or thickness) of each member or ring may be configured to provide specific support responses to sixth sole 1204. In some embodiments, a member and/or ring may be thicker or wider in one region of first layer 1210 and/or third layer 1230 to provide a wearer with greater stability in that region. In another embodiment, members 1200 and/or rings 1250 may be more closely arranged to provide greater stability. For example, there may be a higher density of members 1200 in forefoot portion 105 relative to other portions in order to provide increased support to the forefoot if desired.

For purposes of reference, a first member 1212, a second member 1214, and a third member 1216 are identified in first layer 1210. When sixth sole 1204 is assembled, first member 1212 is arranged such that it appears to "intersect" or overlay first ring 1232, extending upward toward the toe region of forefoot portion 105, and second member 1214 is arranged such that it appears to intersect with second ring 1233 and extend outward toward the rearmost region of heel portion 145. In addition, third member 1216 is disposed such that it extends across from medial side 165 to lateral side 185 in a direction substantially aligned with lateral axis 190.

In some embodiments, one or more of the intersections that occur during the overlap between members 1200 and rings 1250 of first layer 1210 and third layer 1230 may produce regions of first layer 1210 and/or third layer 1230 that permit greater stiffness and a specialized articulation or bending between different regions. Furthermore, in some embodiments, the spaces between adjacent rings 1250 and/or adjacent members 1200 can provide means for decoupling or softening portions of a support or stability layer in order to enhance its flexibility or ability to interact with a cushioning layer. Thus, each region of the support or stability layer can be arranged to increase responsiveness, comfort, resilience, shock absorption, elasticity, and/or stability present in a portion of the layer. Furthermore, members 1200 or rings 1250 can be formed in various portions of a layer to produce regions of overlap between portions of the two layers that are better able to articulate or bend with respect to one another.

As noted above, in different embodiments, third layer 1230 may include any of the features, properties, material compositions, dimensions, and geometries of first layer 1210. Thus, in some embodiments, first layer 1210 may be substantially similar to third layer 1230. However, in other embodiments, first layer 1210 may vary from third layer 1230. For example, in FIGS. 12 and 13, the relative rigidity associated with portions or members of first layer 1210 may be configured to modify, tune, or otherwise adjust the overall stability, flexibility, and structural support through sixth sole 1204 in a manner different from that of third layer 1230. Specifically, in some embodiments, the properties associated with third layer 1230 may interact with and provide a combined effect with the properties associated with first layer 1210 to allow a specialized support response in sixth sole 1204. For example, the varying stiffness associated with third layer 1230 may complement or supplement the stiffness that is associated with first layer 1210 in order to provide a sole system that is configured for improved stability and cushioning for a wearer.

In some embodiments, first layer 1210 may differ in rigidity relative to third layer 1230. In one embodiment, third layer 1230 may have less rigidity relative to first layer 1210. In another embodiment, third layer 1230 may have a rigidity that is substantially similar to the rigidity of first layer 1210. In still other embodiments, as in FIGS. 12 and 13, third layer 1230 can be substantially more rigid than first layer 1210. For example, the overall stiffness associated with the portions of third layer 1230 is greater than the overall stiffness associated with the portions of first layer 1210 in the embodiment depicted in FIGS. 12 and 13. However, it should be understood that in some other embodiments, there may be one or more members or portions of first layer 1210 that are relatively more rigid than one or more members of third layer 1230. Furthermore, within the same layer, there may also be portions that are relatively less rigid than another portion, allowing the relative rigidity of each set to vary throughout the layers of sixth sole 1204.

In addition, in some embodiments, first layer 1210 and third layer 1230 can form a cooperative support system in sixth sole 1204. In some embodiments, this arrangement can provide improved responsiveness in sixth sole 1204, as well as increased stability and durability. Furthermore, the arrangement can interact with one or more cushioning layers (here, second layer 1220) and allow substantial flexibility to remain throughout sixth sole 1204. This configuration may also, for example, more readily distribute forces throughout sixth sole 1204 from heel portion 145 to midfoot portion 125 and to forefoot portion 105. In one embodiment, torsional rigidity may be increased as a result of the configuration of sixth sole 1204. In one embodiment, due to the partial overlap of first layer 1210 and third layer 1230, sixth sole 1204 may be configured to be more rigid in regions of overlap, while having greater flexibility in regions where only a single layer—or no support or stability layer material—is present.

In other embodiments, it should be understood that additional materials or components may be included within any of the sole structures described herein. In some embodiments, to enhance the impact strength of a sole structure, there may be a portion of rubber or dampening material adhered to one surface or portion of a sole layer, for example. In other embodiments, insulating material or other filler or cushioning material may be deposited around regions of the sole structure, or different traction elements may be included.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A sole structure for an article of footwear, comprising: a forefoot portion, a midfoot portion, and a heel portion;

a first cushioning layer, a second cushioning layer, and a stability layer;

the stability layer being disposed between the first cushioning layer and the second cushioning layer, wherein the stability layer is asymmetric and extends throughout each of the forefoot portion, the midfoot portion, and the heel portion of the sole structure, wherein the stability layer comprises: (a) a backbone segment positioned at and corresponding with a portion of an outermost perimeter of an outermost lateral edge of the sole structure, wherein the backbone segment is elongated along the outermost lateral edge of the sole structure, and (b) a plurality of elongated members extending from the backbone segment toward a medial side of the sole structure;

the first cushioning layer extending continuously through the forefoot portion, the midfoot portion, and the heel portion, and the second cushioning layer extending continuously through the forefoot portion, the midfoot portion, and the heel portion; and wherein a stiffness of the first cushioning layer is less than a stiffness of the stability layer.

2. The sole structure of claim 1, wherein the stability layer is arranged to provide increased torsional rigidity to the sole structure.

3. The sole structure of claim 1, wherein a portion of the first cushioning layer is in direct contact with a portion of the second cushioning layer.

4. A sole system for an article of footwear, the sole system comprising: a forefoot portion, a midfoot portion, and a heel portion;

a sole structure with at least three layers, including a first layer, a second layer, and a third layer;

wherein the sole structure is disposed between an upper and a ground-contacting outsole of the article of footwear;

the second layer being an asymmetric layer disposed between the first layer and the third layer, wherein the second layer comprises: (a) a backbone segment positioned at and corresponding with a portion of an outermost perimeter of an outermost edge of the sole structure, wherein the backbone segment is elongated along the outermost lateral edge of the sole structure, and (b) a plurality of elongated members extending from the backbone segment toward an opposite outer edge of the sole structure;

the first layer having a first stiffness, the second layer having a second stiffness, the third layer having a third stiffness;

wherein the first stiffness is less than the second stiffness, and wherein the third stiffness is less than the second stiffness; and wherein the sole structure is configured to disperse pressure throughout the sole structure.

5. The sole system of claim 4, wherein the second layer extends from the forefoot portion to the heel portion.

6. The sole structure of claim 1, wherein the stability layer is made from a material selected from the group consisting of: a thermoplastic, a carbon-fiber-reinforced plastic, a glass-reinforced plastic, and a carbon nanotube reinforced polymer.

7. The sole structure of claim 1, wherein the plurality of elongated members have linear sides edges extending away from the backbone segment.

8. The sole structure of claim 1, wherein at least a majority of the plurality of elongated members are arranged in parallel to one another.

9. The sole structure of claim 1, wherein each of the first cushioning layer and the second cushioning layer includes a foamed polymer material.

10. A sole structure for an article of footwear having a forefoot portion, a midfoot portion, and a heel portion, the sole structure comprising:

a first cushioning layer extending continuously through the forefoot portion, the midfoot portion, and the heel portion; and a stability layer disposed below the first cushioning layer, wherein the stability layer is asymmetric and extends continuously from the forefoot portion, through the midfoot portion, and to the heel portion of the sole structure, wherein the stability layer comprises: (a) a backbone segment positioned at and corresponding with a portion of an outermost perimeter of an outermost lateral edge of the sole structure, wherein the backbone segment is elongated along the outermost lateral edge of the sole structure, and (b) a plurality of elongated members extending from the backbone segment toward a medial side of the sole structure, and wherein a stiffness of the first cushioning layer is less than a stiffness of the stability layer.

11. The sole structure of claim 10, wherein the stability layer is made from a material selected from the group consisting of: a thermoplastic, a carbon-fiber-reinforced plastic, a glass-reinforced plastic, and a carbon nanotube reinforced polymer.

12. The sole structure of claim 10, wherein at least a majority of the plurality of elongated members are spaced at regular intervals.

13. The sole structure of claim 10, wherein at least a majority of the plurality of elongated members are arranged in parallel to one another.

14. The sole structure of claim 10, wherein the first cushioning layer includes a foamed polymer material.

15. The sole structure of claim 10, wherein the stability layer is made from a material selected from the group consisting of: a thermoplastic, a carbon-fiber-reinforced plastic, a glass-reinforced plastic, and a carbon nanotube reinforced polymer; wherein the first cushioning layer includes a foamed polymer material; and wherein at least a majority of the plurality of elongated members are arranged in parallel to one another.

16. The sole structure of claim 15, wherein at least a majority of the plurality of elongated members are spaced at regular intervals.

17. The sole structure of claim 1, wherein the backbone segment constitutes a singular backbone segment included in the stability layer.

18. The sole structure of claim 1, wherein the backbone segment is continuously curved along the outermost lateral edge of the sole structure.

19. The sole system of claim 4, wherein the backbone segment constitutes a singular backbone segment included in the second layer.

20. The sole system of claim 4, wherein the backbone segment is continuously curved along the outermost edge of the sole structure.

21. The sole structure of claim 10, wherein the backbone segment constitutes a singular backbone segment included in the stability layer.

22. The sole structure of claim 10, wherein the backbone segment is continuously curved along the outermost lateral edge of the sole structure.

* * * * *